US006155438A

United States Patent [19]

Close

[11] Patent Number: 6,155,438

[45] Date of Patent: Dec. 5, 2000

[54] SYSTEM AND METHOD FOR PRODUCT DISPLAY, ARRANGEMENT AND ROTATION

[76] Inventor: James Garth Close, 106 Elderberry St., Georgetown, Tex. 78628

[21] Appl. No.: 09/312,118

[22] Filed: May 14, 1999

Related U.S. Application Data

[60] Provisional application No. 60/085,434, May 14, 1998.

[51] Int. Cl.[7] ..... A47F 5/00

[52] U.S. Cl. ..... 211/59.3; 211/119.003; 211/184; 211/DIG. 1; 312/71

[58] Field of Search ..... 211/59.2, 59.3, 211/119.003, 90.02, DIG. 1, 184, 175; 312/61, 71

[56] References Cited

U.S. PATENT DOCUMENTS

| | | | |
|---|---|---|---|
| 1,702,987 | 12/1929 | Wilso . | |
| 1,910,046 | 5/1933 | Pascoe . | |
| 2,079,754 | 5/1937 | Waxgise . | |
| 2,098,844 | 12/1937 | Waxgise . | |
| 2,980,259 | 4/1961 | Fowlds . | |
| 4,488,653 | 12/1984 | Belokin | 211/184 |
| 5,123,546 | 6/1992 | Crum . | |
| 5,203,463 | 4/1993 | Gold . | |
| 5,240,125 | 8/1993 | Kunz . | |
| 5,240,126 | 8/1993 | Foster et al. . | |
| 5,413,229 | 5/1995 | Zuberbuhler et al. | 211/59.3 |
| 5,469,976 | 11/1995 | Burchell | 211/59.3 |
| 5,881,910 | 3/1999 | Rein | 211/6 |
| 5,893,467 | 4/1999 | Burchell | 211/54.1 |

*Primary Examiner*—Robert W. Gibson, Jr.
*Attorney, Agent, or Firm*—David Fink

[57] ABSTRACT

A system for displaying products generally forming a queue on a display surface comprising a receiving apparatus operable for receiving products to be displayed. The receiving apparatus includes a surface for receiving the products in a queue. The surface has front and rear portions and is magnetically attracted to a magnet. The system also has an arranging mechanism operable for moving the products selectively and manually from the rear portion of the surface towards the front portion of the surface. The arranging mechanism comprises a positioning element having a vertical portion adapted to engage the rear product in the queue from the rear side of the product and has a horizontal portion extending parallel to the surface towards the front portion of the surface. The first and second elements each have a base with an upper and lower portion. The first and second elements are spaced apart and define a channel to receive and to support the products on the upper portions. The first and second elements are maintained in predetermined positions on the surface magnetically. The horizontal portion is positioned between said first and second elements in said channel and extends under the products so that the vertical portion is positioned to engage the rear product in the vicinity of its geometric center generally corresponding to the center of gravity of the rear product, thereby allowing the rear product to be engaged by the vertical portion for movement from a position in the rear portion to a predetermined position closer to the front portion of the surface with a minimum of forces tending to move the rear product towards one of the first and second elements.

13 Claims, 20 Drawing Sheets

SYSTEM AND METHOD FOR PRODUCT DISPLAY, ARRANGEMENT AND ROTATION

CROSS-REFERENCE TO RELATED APPLICATIONS

This nonprovisional patent application is related to the provisional application having serial number 60/085,434 filed on May 14, 1998.

STATEMENT REGARDING FEDERALLY FUNDED RESEARCH OR DEVELOPMENT

Not Applicable

REFERENCE TO A MICROFICHE APPENDIX

Not Applicable

BACKGROUND OF THE INVENTION

1. Field of the Invention

The invention relates to the display, arrangement and rotation of products such as food boxes, cans and the like in a supermarket, and more particularly to an improved product display, arrangement and rotation system and method in which products displayed on a shelf can easily be arranged or rotated to have the products' expiration dates kept safely up to date and to conveniently position the products manually near the front edge of the shelves for improved visual exposure and effortless selection by consumers.

2. Description of Related Art

Retail stores relying on the consumers to serve themselves have recognized the importance of having products on the shelves near the front edge of the shelves so that the products can be readily seen by consumers and easily reached by the consumers. This merchandising plan is subverted without any nefarious intentions by consumers who purchase the products by removing the products from the shelf, ordinarily from the front of the line of products. As time goes by, the sale of the products results in the removal of additional products until only products formerly in the back remain. In many cases, the products near the back of the shelves are difficult for consumers to reach, particularly when the products are on relatively high shelves and the consumers are shorter than the height of these shelves.

Well operated retail stores have clerks move around the store periodically to check the status of goods and make appropriate corrections by moving products toward the front. The cost of workers today, even for unskilled clerks in supermarkets, are relatively high and can substantially reduce the potential operating profits of the stores. Accordingly, many stores elect to accept poor product displays and awkwardly positioned goods to save on the operating costs. Naturally, this adversely affects sales; however, no quantitative measure is available.

From a subjective point of view, anyone who has encountered a display in which a preferred product was difficult to reach can appreciate the discouraging interest in straining oneself to make a purchase. Consumers often search for a clerk to reach a product, thereby interrupting the clerk from his assigned duties. On the other hand, a determined consumer may risk injury in climbing to reach a product, thereby creating a potential liability for the retail store.

The rotation of products and especially perishable products is a major concern for retail stores and consumers. Perishable products must be sold by a certain date or be pulled from the shelves because of spoilage. If the products are not rotated to the front of the shelf, then as newer products are placed on the shelves, then the older products remain near the rear of the shelves out of the reach of the shopper. Having these older products remain in the rear increases the likelihood that they will not be sold and will be pulled from the shelves or worse yet that they will be purchased by a consumer after their expiration dates have passed. Consumers sometimes forget to review the expiration date of a product and rely on the retail store to maintain up to date safe products. The retail store owner is at the mercy of the product stocker to rotate the products. With the current manual system, where a stocker must manually remove each product by hand, a product stocker may be more inclined to not rotate and just put the newer products towards the front of the shelf, thereby leaving the store open to lost products and lost customers who get sick on spoiled products. A system for the easy rotation of products is needed to decrease the likelihood that a product will have to be discarded after reaching its expiration date.

There have been attempts in the prior art to provide systems for overcoming the problem of providing an easily operated display system for presenting products near to front of the shelves to enable consumers to reach the products easily. Some of these are discussed in the following.

U.S. Pat. No. 5,203,463 to Steven K. Gold uses springs to "automatically" push items to the front position on the display shelf. Similar systems are currently in use in highly specialized displays such as for cigarette packages. One of the problems with the '463 patent is that to move the cigarette packages forward to a suitable position, the system must be carefully engineered for the weight of the packages as well as the length of the desired movement from the display being full of cigarette packages until only one package is left. This places critical requirements on the spring because it must be selected to be compatible with the weight of the products as well as the distance through which movement is required for substantially all of the products. After the first product is taken, almost a full line of products must be moved. When only a few products remain, the force required for movement is substantially less. This system does not facilitate the rotation the efficient and quick rotation of products for the health and welfare of consumers.

The '463 patent may be satisfactory for a relatively light product such as packages of cigarettes, but it would not be suitable for many heavier goods, such as canned soup, because the heavier goods make the requirements for the spring extremely difficult to fulfill. The spring must be much stronger to properly move a line-up of heavy soup cans and the length of movement required would be a difficult problem to overcome. Typically, food display shelves vary in depth from 24 inches down to 10 inches or less. Anyone who has had experience with springs can appreciate immediately the enormous problems in trying to install such a system throughout a food store with all the variables involved such as heavy products, light products, as well as the differences in the required movement of the spring from compressed to extended to be compatible with product package sizes and various shelf depths. Rotating products is also made difficult by the spring. The old products would need to be removed. The system makes has no mechanism set up to accept the old products while the newer products are being used to force the spring back. Rotating products with this system is more difficult than having no system in place. Indeed, the likelihood of clerks not rotating may go up if this system is used.

Another problem, besides the springs, with the '463 patent is that the "supporting structure" disclosed in the patent is a complex device which must be especially sized for all the different depths of shelves on which it might be mounted. The width of the device in the '463 patent would need to be easily adjustable. There would be some installations which need to be only a few inches wide, others larger. The store personnel would not be able to install such a system universally. It would require a trained technician with the special tools and skills to do the installations by cutting the base unit into smaller sections. The cost and complexity of the system disclosed in the '463 patent has apparently discouraged its use and inhibited it from being a popular system.

As with any system used in a supermarket or the like, the system must be both practical and cost effective. It is unlikely that a store would be willing to spend a large amount of money for the control of a single row of merchandise when there are thousands of items in a store which require a comparable system.

Another problem with the system disclosed in the '463 patent is that once a consumer has removed an item from the display and decides not to buy it, it will be necessary for the consumer to overcome the power of the forward thrust of the spring to place the item back into the queue. Most consumers become annoyed at such inconvenience and it is likely that the item will be left somewhere else in the store because most people usually refuse to be bothered with a system requiring some effort.

U.S. Pat. No. 5,240,126 to Foster also uses a spring arrangement to advance a row of items forward; however, rather than a coil spring used in the '463 patent, it uses a ribbon spring similar to the spring used in a tape measure. The system disclosed in the '126 patent is very effective if used for the weight of the item it is designed for, but it is not adaptable to a wide range of items of different weights. Accordingly, the '126 patent has the same limitations as the system disclosed in the '463 patent. Additionally, products having expiration dates come in all shapes and sizes and need to be rotated. This spring also does not have a mechanism that facilitates the efficient rotation of products including perishable products.

U.S. Pat. No. 5,240,125 to Kunz is similar to the '126 patent, with a similar "tape measure" type spring except that a protective wire grid has been added to prevent a glass jar from falling out of the device. Thus, the '125 patent has similar disadvantages as the '126 patent. Also, the wire grid makes removing old products for the rotation of products even more difficult leading to the likelihood that it will not be performed.

U.S. Pat. No. 5,123,546 to Crum is very similar to the '126 patent with a "tape measure" type spring to propel the row of items forward. The '546 patent has the same limitations in that it must be specifically tailored to a particular item such as cigarette packages, or birthday candles packages which are similar in size and shape to a cigarette package. Furthermore, it must be designed specifically for the display shelf it is to be mounted upon. The system of the '546 patent is currently in use in stores and it appears satisfactory for relatively small, light weight products such as cigarette boxes and birthday candle cartons. It may be feasible to construct a larger system based on the '546 patent for other specific packages, shelf sizes, weights of items, etc., but it is unlikely that this would be cost effective.

BRIEF SUMMARY OF THE INVENTION

The invention relates to a system and method for displaying and rotating products generally forming a queue on a display surface. One embodiment according to the invention comprises a receiving means operable for receiving products to be displayed. The receiving means includes a surface for receiving the products in a queue with the surface having front and rear portions and is magnetically attracted to a magnet. Further, the embodiment according to the invention comprises an arranging means operable for moving the products selectively and manually from the rear portion of the surface towards the front portion of the surface. The arranging means comprises a positioning element having a vertical portion adapted to engage the rear product in the queue from the rear side of the product and a horizontal portion extending parallel to the surface towards the front portion. The first and second elements each having a base with an upper and lower portion and are spaced apart to define a channel to receive and to support the products on the upper portions. The first and second elements are maintained in predetermined positions on the surface magnetically while the horizontal portion is positioned between the first and second elements in the channel and extends under the products so that the vertical portion is positioned to engage the rear product in the vicinity of its geometric center generally corresponding to the center of gravity of the rear product, thereby allowing the rear product to be engaged by the vertical portion for movement from a position in the rear portion to a predetermined position closer to the front portion of the surface with a minimum of forces tending to move said rear product towards one of the first and second elements.

In yet another embodiment according to the invention, the positioning element includes indicia identifying the number of the products in the queue when the positioning element is moved so that the products are substantially aligned with the front portion of the surface. The indicia may also contain information corresponding to the products in the queue. Additionally, the indicia may also be a bar code.

Yet another embodiment according to the invention comprises a temporary shelf extending means for extending a shelf or product receiving means and receiving products from the surface of the shelf to facilitate the rotation of older products from the rear portion of the surface to the front portion and newer products to the rear portion of the surface. The shelf extending means comprising means to engage the receiving means for maintaining the shelf extending means in a predetermined position.

Another embodiment according to the invention comprises an enhancing means for enhancing the distribution of a force on the rear surface of the rear product in the product queue so that the force is distributed over a predetermined larger area.

A method according to the invention for arranging products to be displayed, comprising the steps of providing a shelf with first products arranged in a queue, said shelf having a front and rear portion. Providing second products to be displayed on said shelf in said queue. Providing a movable shelf capable of being positioned to the height of said shelf so that said first products can be moved onto said movable shelf with a smooth transition. Positioning said movable shelf so that it is positioned to receive said first products. Moving said first products from said shelf onto said movable shelf Moving said second products onto said movable shelf. Positioning said second products towards the rear portion of said shelf. Finally, moving said first products from said movable shelf onto said shelf generally in front of said second products.

Yet another method according to the invention is a method for arranging and displaying products generally forming a queue and taking an inventory, comprising the steps of providing a shelf generally for receiving products to be displayed and having a front and rear portion. Providing products having front and rear sides for arrangement and display on said shelf generally in a queue having a front and rear product. Providing an arranging means for attachment to said shelf The arranging means defining a channel for receiving and supporting said products. The arranging means further having an element with a vertical portion adapted to engage the rear product in the queue from the rear side of said product and a horizontal portion extending parallel to said surface towards said front portion under the products having indicia corresponding to the products in the queue including the number of said products. Positioning said element in said channel so that said vertical portion is set to engage the rear product in the vicinity of its geometric center generally corresponding to the center of gravity of said rear product, thereby allowing said rear product to be engaged by said vertical portion for movement from a position in the rear portion to a predetermined position closer to the front portion of said surface with a minimum of forces tending to move said rear product towards one of said first and second elements. Positioning said products in said channel generally in the form of a queue. Selectively moving the products manually from the rear portion of the shelf towards the front portion of the shelf by applying a force on said horizontal portion of said element generally in a direction of the front portion of the shelf, thereby engaging the rear product with said vertical portion until the first product is located at a predetermined position near the front portion of the shelf Reading said indicia to determine the number of products remaining in said queue. Finally, returning said element to its original position by applying a force on said horizontal portion of said element generally in a direction of the rear portion of said shelf until said element reaches its original position.

DETAILED DESCRIPTION OF THE INVENTION

EMBODIMENT 1

The invention aids in allowing a seller of consumer goods at a location such as a supermarket to efficiently maintain inventory, order among the products on the shelves and an overall look of cleanliness and structure. Such aspects contribute greatly to overall customer satisfaction and customer return. The system uses display shelf divider tracks to maintain separate rows of products and allows products to be moved to the front edge of the shelves easily and selectively. Because space on shelves is a precious commodity in super markets, the display divider tracks are designed to occupy a minimum of space. Additionally, when in use the display shelf divider according to the invention is mostly hidden from the consumer and does not obstruct the view of the products. A majority of the display divider is covered by the products. The products rest on the tracks leaving an area under each row. A slide bar moves easily in the space between the shelf and the slightly raised products. The slide bar has a vertical arm for engaging the products from the rear so that the products can be moved forward using the slide bar.

As products are sold, a clerk pulls the slide away from the shelf and engage the row of remaining products with the vertical arm of the slide bar, moving them to the front of the shelf edge. The divider tracks serve to limit product mixing and keep the products in an orderly line.

Figure 1A:
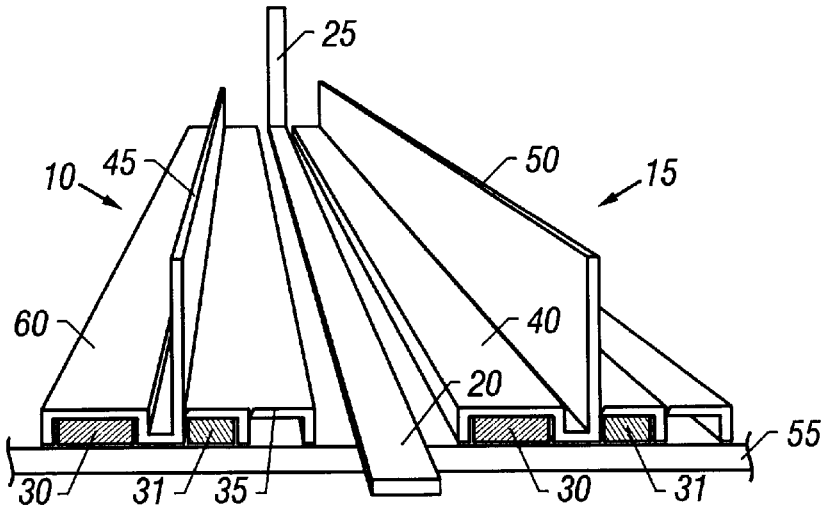
FIG. 1*a* is a perspective view of one embodiment according to the invention.
Figure 1B:
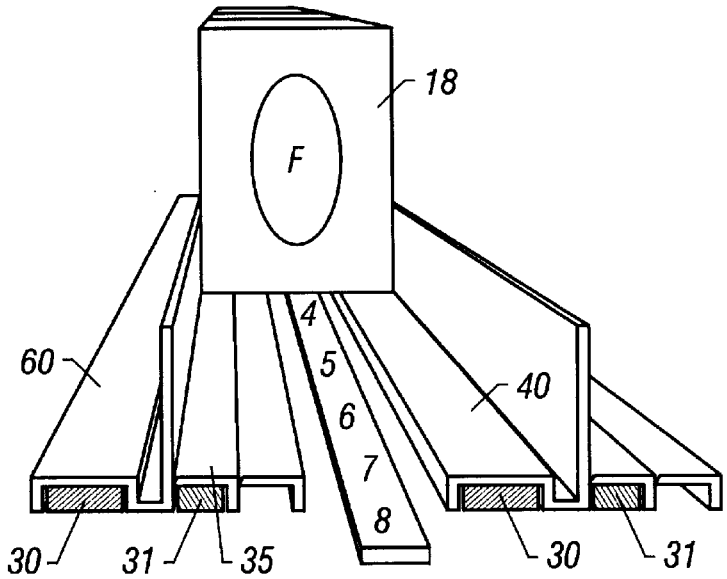
FIG. 1*b* is a perspective of another view of the embodiment shown in FIG. 1*a* with products added according to the invention.
Figure 1C:
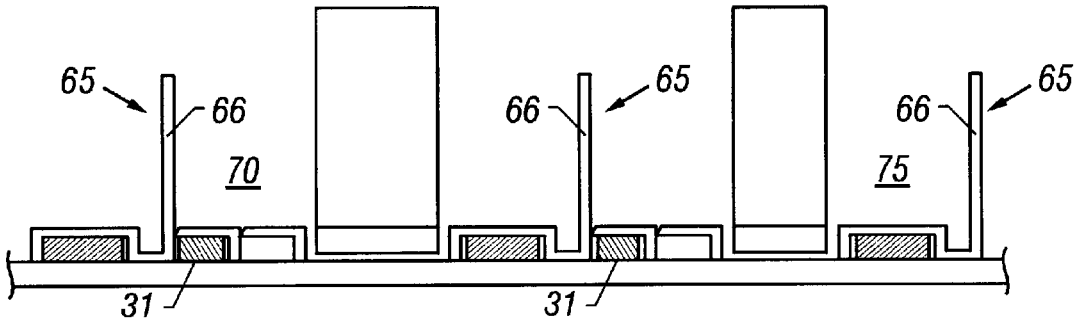
FIG. 1*c* is front elevational view of one embodiment according to the invention.

FIG. 1*a* shows one embodiment according to the invention. This embodiment has two display shelf dividers 10 and 15 with a slide bar 20 having a vertical arm 25. FIG. 1*b* shows the display shelf dividers 10 and 15 spaced far enough apart so that a row of products 18 rest on base plates 35 and 40 in between divider walls 45 and 50. The display shelf dividers 10 and 15 are maintained in a predetermined position on a metal shelf 55 by magnetic strips 30 affixed under base plates 40 and 60. The magnetic strip 30 can be bonded, screwed to or attached in any method to the base plates 40 and 60. Additional magnetic strips 31 can be used to enhance the connection to the metal shelf 55. Using magnetic material as the preferred method of adhering the shelf dividers 10 and 15 to the shelf 55 allows maximum flexibility in adjusting the shelf dividers 10 and 15 for products. The magnetic material can be easily detached from the shelf 55 and allows the shelf to be easily adjusted for other products. The slide bar 20 is able to move forwards and backwards under the row of products allowing the vertical arm 25 to engage the rear product in the vicinity of its geometric center generally corresponding to the center of gravity of said rear product. The vertical arm 25 may tend to bend out of shape after prolonged use, however, it will continue to apply a central force to the rear product and reduce the rotational movement of the products towards either divider wall 10 or 15. FIG. 1 c shows an end view of three display shelf dividers 65 forming two product channels 70 and 75. The shelf dividers 65 each have a divider wall 66 that keeps the two queues of products separated and supports the products as they are moved forward through the channels 70 and 75.

An unskilled is capable of deploying the system on the shelves of a retail store. The display shelf dividers 10 and 15 are produced and transported to the retail store in lengths longer than the shelves. After the desired length of the display shelf divider is determined, the transported display shelf dividers is cut to the desired length and attached to the shelf. Ease of setup and use is a prevailing advantage of the system according to the invention.

Figure 2A:
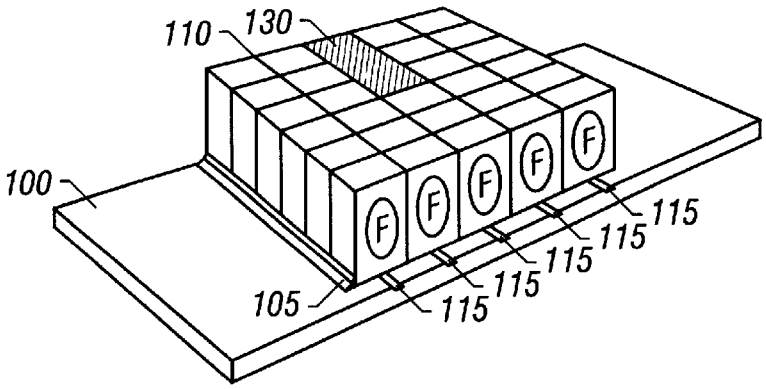
FIG. 2*a* is a perspective view showing how one embodiment according to the invention is used.

FIGS. 2*a*–2*d* show how six display shelf dividers are used on a shelf unit according to the invention. In FIG. 2*a* a shelf unit 100 has 6 sets of display shelf dividers 105 (only one is visible) positioned lengthwise on each side of each of 5 rows of products 110. According to the invention, a slide bar 115 is positioned between each adjacent set of display shelf dividers and under each row of products 110. Each slide bar 115 has a vertical arm, as seen in FIG. 1*a* vertical arm 25, positioned behind a row of products 110 to engage the rear product in the vicinity of its geometric center generally corresponding to the center of gravity of the rear product when the slide bar 115 is pulled away from the display shelf front edge 120. The display shelf dividers 105 keep the products 110 from contacting the display shelf unit 100 and allow the slide bar 115 to move between the underside of products 110 and the shelf unit 100.

Figure 2B:
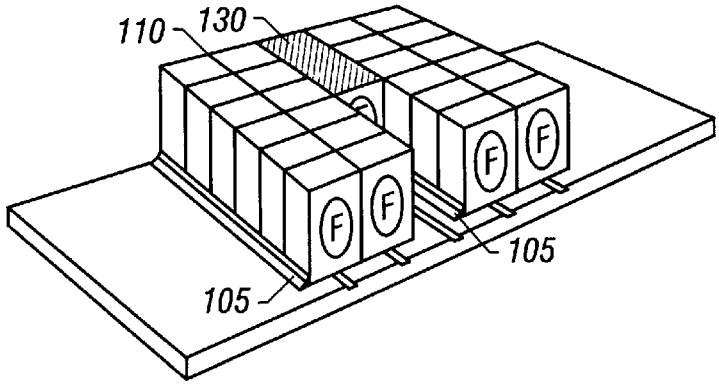
FIG. 2*b* is a perspective view of another step in using one embodiment according to the invention.
Figure 2C:
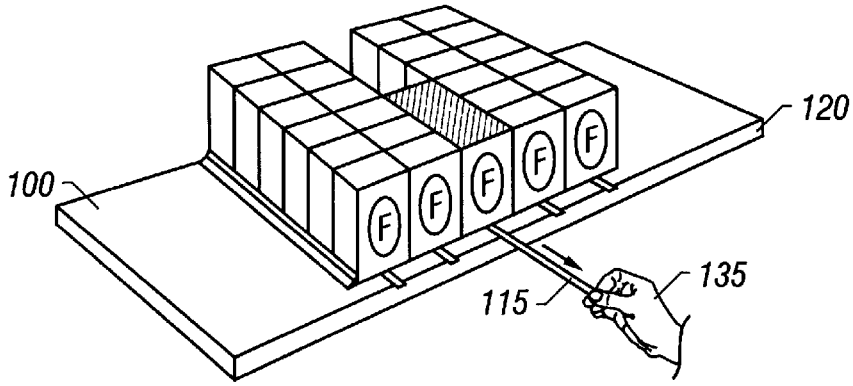
FIG. 2*c* is a perspective view of another step in using one embodiment according to the invention.
Figure 2D:
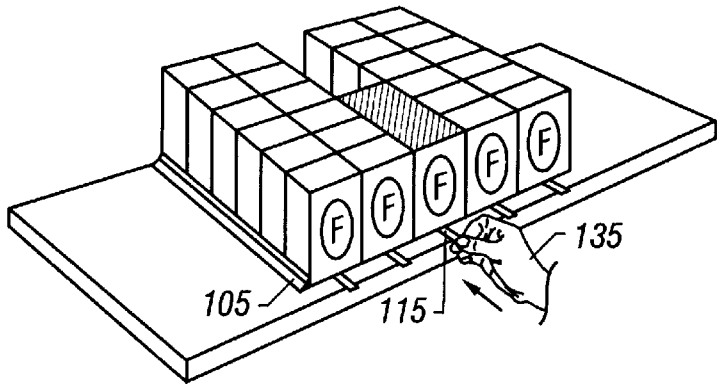
FIG. 2*d* is a perspective view of another step in using one embodiment according to the invention.

FIGS. 2*b*, 2*c* and 2*d* show how products that are located in the back of a row can be brought to the front of the row without having to move each individual product separately. The first three products 110 in row 130 in FIG. 2*b* have been sold. To move the remaining three products closer to the front edge of shelf unit 100, a clerk 135 operates the slide bar 115 by pulling it away from the display shelf front edge 120. The vertical arm of the slide bar 115 engages the back of the last product in row 130 and causes the remaining products in row 130 to move towards the display shelf front edge 120 of shelf unit 100 until their position conforms with the location of the other products 110 in the other rows. In FIG. 2*d*, the clerk 135 returns the slide bar 115 to its original position.

Instead of a clerk fronting the products 130, consumers can use the invention to pull desired products to the front of the shelf 120 to obtain a product that is located at the rear of the shelf 120. By using the invention to obtain a product, the consumer also performs a secondary service for the retail store by also fronting the product. Therefore, the time needed for a clerk to do the fronting may be reduced thanks to consumers and the ease of use of the invention.

Figure 3A:
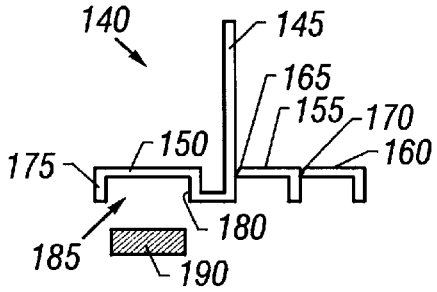
FIG. 3*a* is a front elevational view of one embodiment according to the invention.
Figure 3B:
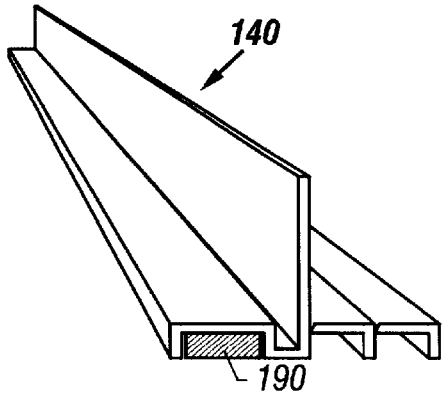
FIG. 3*b* is a perspective view of the embodiment shown in FIG. 3*a*.
Figure 3C:
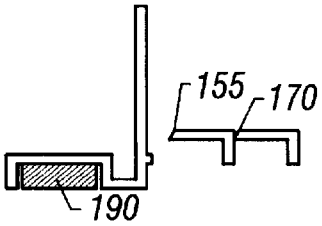
FIG. 3*c* is a front elevational view show a feature of one embodiment according to the invention.
Figure 3D:
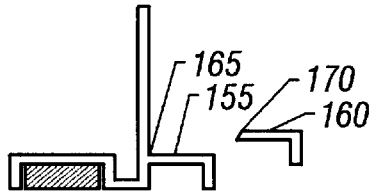
FIG. 3*d* is a front elevational view showing another feature of one embodiment according to the invention.

FIGS. 3*a*–3*e* show one embodiment of a display shelf divider track according to the invention. FIGS. 3*a* and 3*b* show display shelf divider track 140 comprising a vertical divider wall 145 with base plate 150 on one side of divider wall 145 and base plates 155 and 160 on the opposite side of divider wall 145. The width of divider track 140 can be lessened by breaking away base plate 160 at preformed groove 170 as shown in FIG. 3*d* and base plate 155 at preformed groove 165 in FIG. 3*a* to create a display shelf divider as shown in FIG. 3*c*. Base plate 150 has sides 175 and 180 that are parallel to divider wall 145 and extend downward from each lengthwise edge of base plate 150 to engage a shelf unit. The sides 175 and 180 form a channel 185 that extends lengthwise under base plate 150. The display shelf divider track 140 in FIGS. 3*a*–3*d* according to the invention is shown with magnetic strip 190 installed in channel 185. Because most display shelving is ferrous metal, the magnetic strip 190 will locate and secure the display shelf divider track 140 from movement. Although the preferred embodiment is magnetic strip 190, double sided adhesive strips 191 could also be used on an element 192 for both metal and non-ferrous shelving or surfaces as shown in FIG. 3*f* or any other attaching means like a bonding agent, glueing, nailing or screwing in place or some similar arrangement.

Figure 3E:
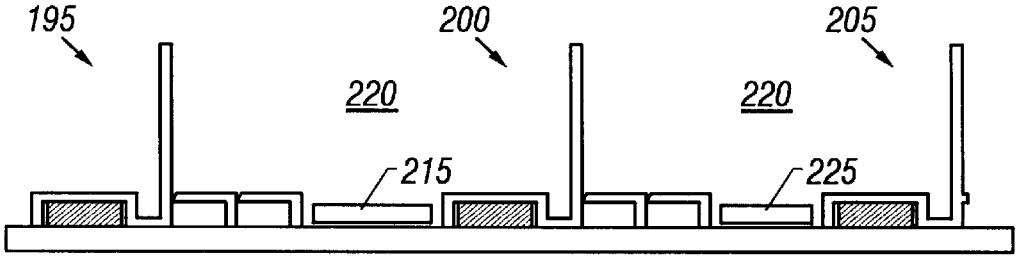
FIG. 3*e* is a front elevational view showing a use for the embodiment shown in FIG. 3*c*.
Figure 3F:
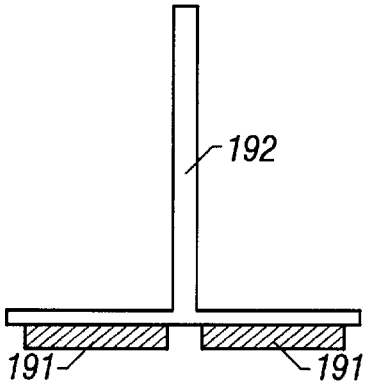
FIG. 3*f* is a front elevational view of an embodiment according to the invention.

Referring to FIG. 3*e*, three display shelf divider tracks 195, 200, and 205 are positioned in parallel fashion on a shelf unit 210 with slide bars 215 and 225 also positioned in parallel fashion between tracks 195 and 200 and between tracks 200 and 205, according to the invention. Products (not shown) are positioned on the base plates in the product channel 220 formed by dividers 195 and 200 and dividers 200 and 205. The width of the product channels 220 are adjusted to accommodate the width of the product by increasing or decreasing the distance between dividers 195 and 200 or dividers 200 and 205 depending on the channel 220 into which the products are to be placed. Additionally, for larger products a slide 215 with an increased width can be used or for smaller products a slide 225 with a standard width can be used. Display shelf divider 205 has been modified as shown in FIG. 3*c* so that it may be used as an end unit on shelf 210 thereby allowing the display shelf divider 205 to conform to the length of the shelf and still maintain a pleasant appearance. Without the breakaway ability of the display shelf divider 205, the end portion of the shelf would be taken up by an unused base plate and would therefore be wasted. If a store is forced to remove products because of wasted unused shelf space then the store will ultimately lose income.

EMBODIMENT 2

Figure 4C:
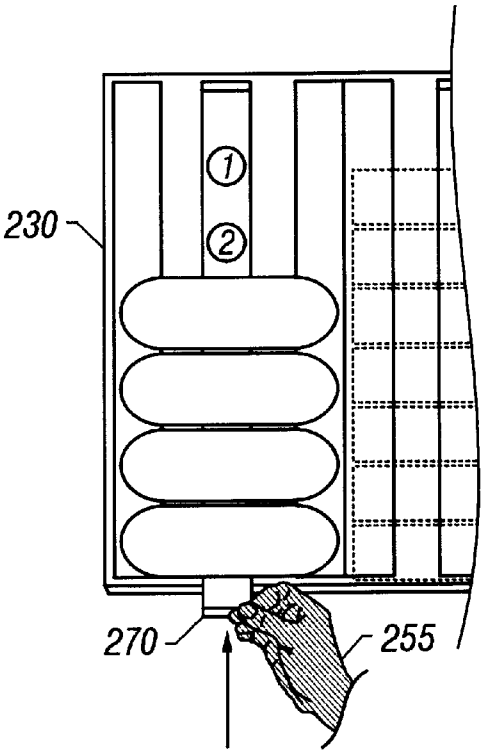
FIG. 4*c* shows the final step for taking an inventory with the embodiment according to the invention.

In another embodiment according to the invention, inventory and product reordering can be efficiently managed while reorganizing, or "fronting" the product shelves. FIG. 4*a* is a fragmented top plan view of the display shelf 230 with consumer products 235 located in the product channel 240, created by display shelf track dividers 245. A consumer has removed two products from the front of the product channel 240, leaving four products 235 in the channel 240, but they are not located at the front shelf edge 250. If this shelf were above eye level then the remaining products 235 would need to be removed from the shelf to determine their number.

Figure 4B:
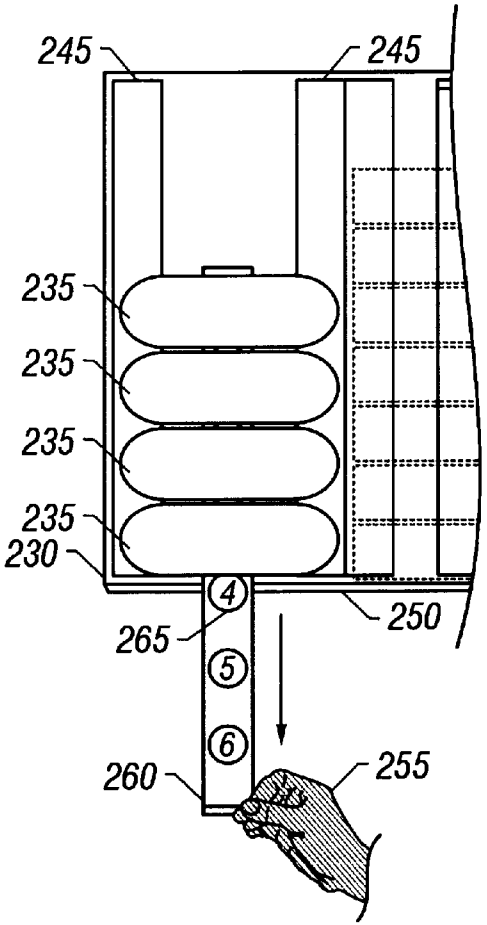
FIG. 4*b* shows another step for taking an inventory with the embodiment according to the invention shown.
Figure 4A:
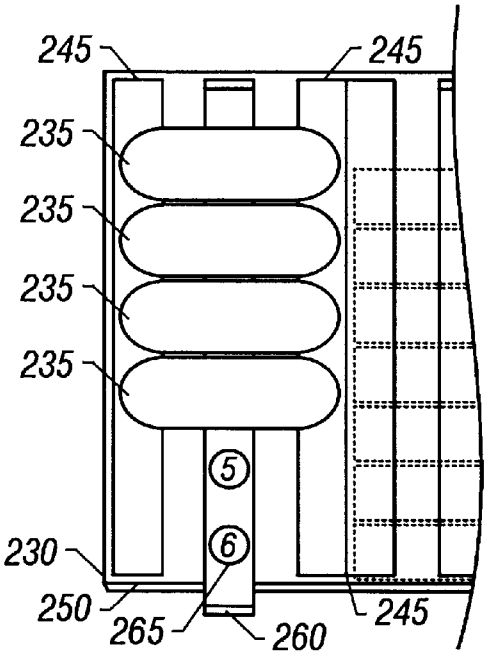
FIG. 4*a* is a top plan view with portions removed showing an embodiment according to the invention for taking inventory of products located on a shelf.

In FIG. 4*b*, a store clerk 255 has activated the slide bar 260 by pulling it away from the display shelf front edge 250. The slide bar 260 is labeled with inventory markers 265 which indicate the remaining number of products 235 left in the product channel 240 when the products 235 are reorganized to the shelf front edge 250. Additionally, if the products 235 are already located at the shelf front edge 250, the number remaining can be determined by activating the slide until it reaches the last product 235. FIG. 1*b* shows a similar embodiment. Although actual numbers are shown here the slide bar 260 may be bar coded so that a clerk 255 may conveniently scan the slide bar as the clerk reorganizes each product channel 240. The bar code may identify not only quantity remaining, but also the product itself, thus producing critical inventory data for automated reordering systems. Other indicia corresponding to the product may also be used.

Referring to FIG. 4*c*, once the products 235 are reorganized, the store clerk 255 returns the slide bar 260 to its original position so that the slide leading edge 270 is once again flush with the display shelf front edge 250.

EMBODIMENT 3

Figure 5A:
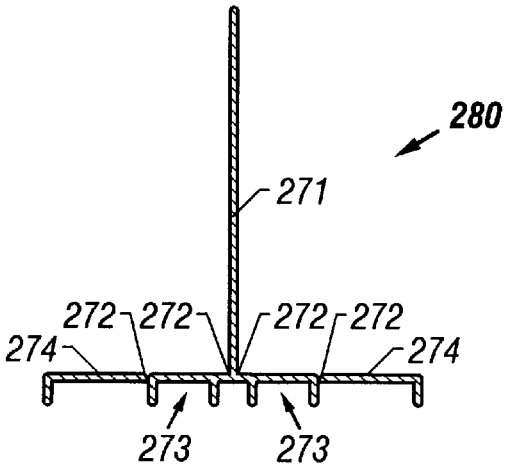
FIG. 5*a* is a front elevational view of one embodiment according to the invention.

FIG.5*a* shows another embodiment of a display shelf divider 280 according to the invention comprising a vertical divider wall 271 and base plate 274 with preformed grooves 272 and magnetic strip channels 273. The base plate 274 of the divider 280 can be adjusted in width by breaking off strips at the preformed grooves 272 on either side of the divider wall 271.

Figure 5B:
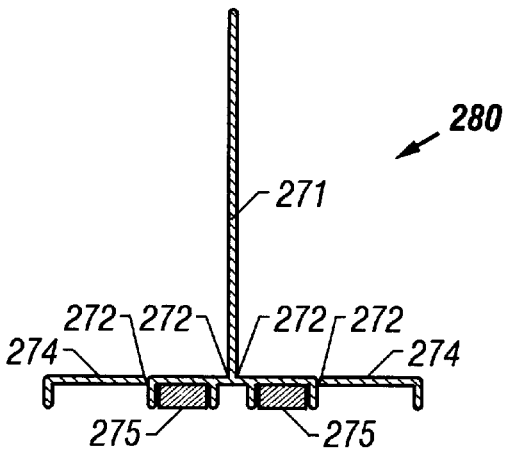
FIG. 5*b* is a front elevational view of the embodiment shown in FIG. 5*a* with magnets added.
Figure 5C:
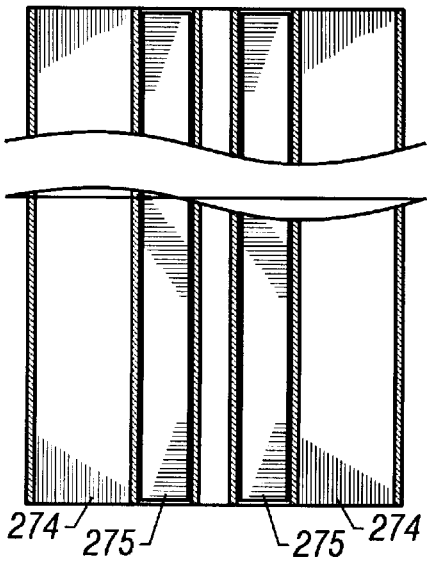
FIG. 5*c* is a plan view with portions removed showing the underside of the embodiment shown in FIG. 5*b* showing that the magnetic strips run the length of the base.

Referring to FIG. 5*b*, a display shelf divider 280 according to the invention is shown with magnetic strips 275 installed in the magnetic strip channels 273. FIG. 5*c* shows a fragmented bottom view of the display shelf divider 280 according to the invention indicating the continuous magnetic strips 275 installed in the magnetic strip channels 273 of the base plate 274.

Figure 5D:
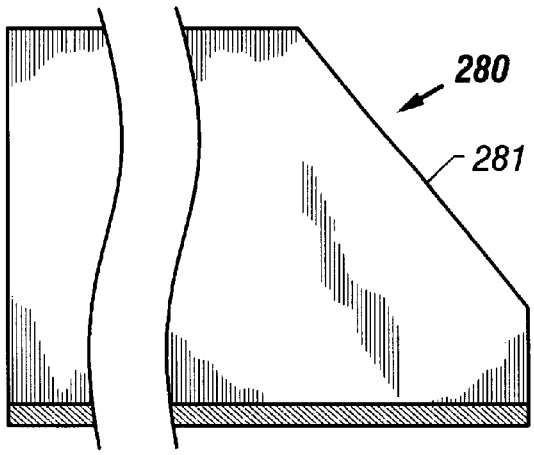
FIG. 5*d* is a side elevational view with portions removed of a divider wall according to the invention.

FIG. 5*d* is a fragmented side elevation view of the display shelf divider 280 according to the invention with a tapered front edge 281 which allows easy access to the consumer products, both mechanically and visually.

Figure 5E:
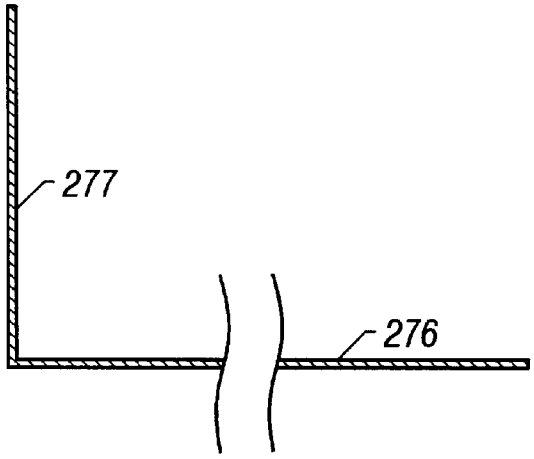
FIG. 5*e* is a side elevational view of the slide bar according to the invention.
Figure 5F:
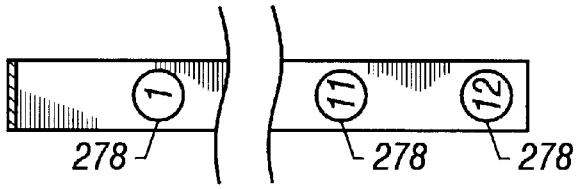
FIG. 5*f* is a top plan view of the slide bar shown in FIG. 5*e*.

FIG. 5*e* is a fragmented side elevation view of the slide 276 according to the invention with a vertical backstop. FIG. 5*f* is a fragmented plan view of the slide 276 with inventory markers indicating the continuous slide 276.

EMBODIMENT 4

Another embodiment according to the invention is used in conjunction with the aforementioned embodiments to easily and efficiently aid in necessary product rotation. Product rotation is necessary to enhance the public health by keeping perishable products fresh and safe for consumption. Failure to use product rotation could cause harm to consumers and precipitate serious liability. To rotate products, a store clerk must remove the products from a row and check the expiration dates to determine if the products should remain on the shelf. If the clerk is adding newer products to the row then the newer products are placed behind the older products, providing for a first-in first-out system. Because shelf space is used so efficiently, there is seldom space for the temporary storage of older products while newer products are being placed in the back of the row. Instead, the clerk must remove the products to a remote location, place the newer products on the shelf and finally retrieve the older products.

Figure 6A:
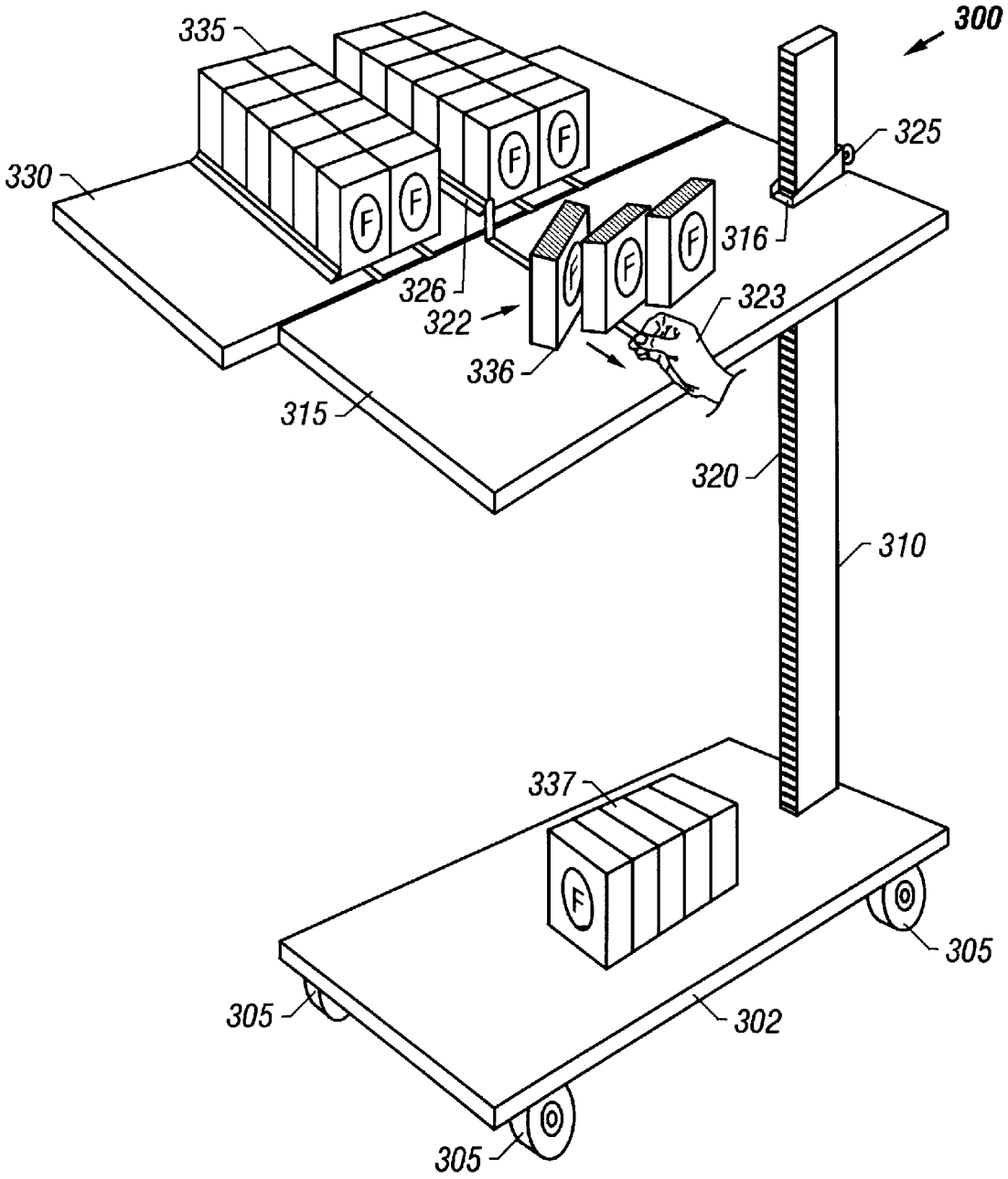
FIG. 6*a* is a perspective view of one embodiment of the product rotation system according to the invention.

FIG. 6*a* shows a receiving means 300 according to the invention for providing efficient product rotation according to the invention. Receiving means 300 provides an elevated spacious surface to receive products 336 being slid off store shelf 330. The receiving means 300 preferably has a support platform 302 which is movable with wheels 305. The platform 302 has a vertical member 310 which supports a movable shelf 315 that is selectively movable vertically. The vertical member 310 has slots 320 and the movable shelf 315 has an extension 316 that engages a selected slot 320. A thumb screw 325 allows the operator to tighten the engagement of the extension 316 into the selected slot 320 to prevent the movable shelf 315 from moving downward, particularly when the movable shelf 315 is loaded with products 336. The movable shelf 315 preferably is arranged to be slightly lower than the store shelf 330, containing the products 335, so that older products 336 can be slid from store shelf 330 onto movable shelf 315 without encountering a barrier formed if the movable shelf 315 were slightly higher than store shelf 330.

Figure 6B:
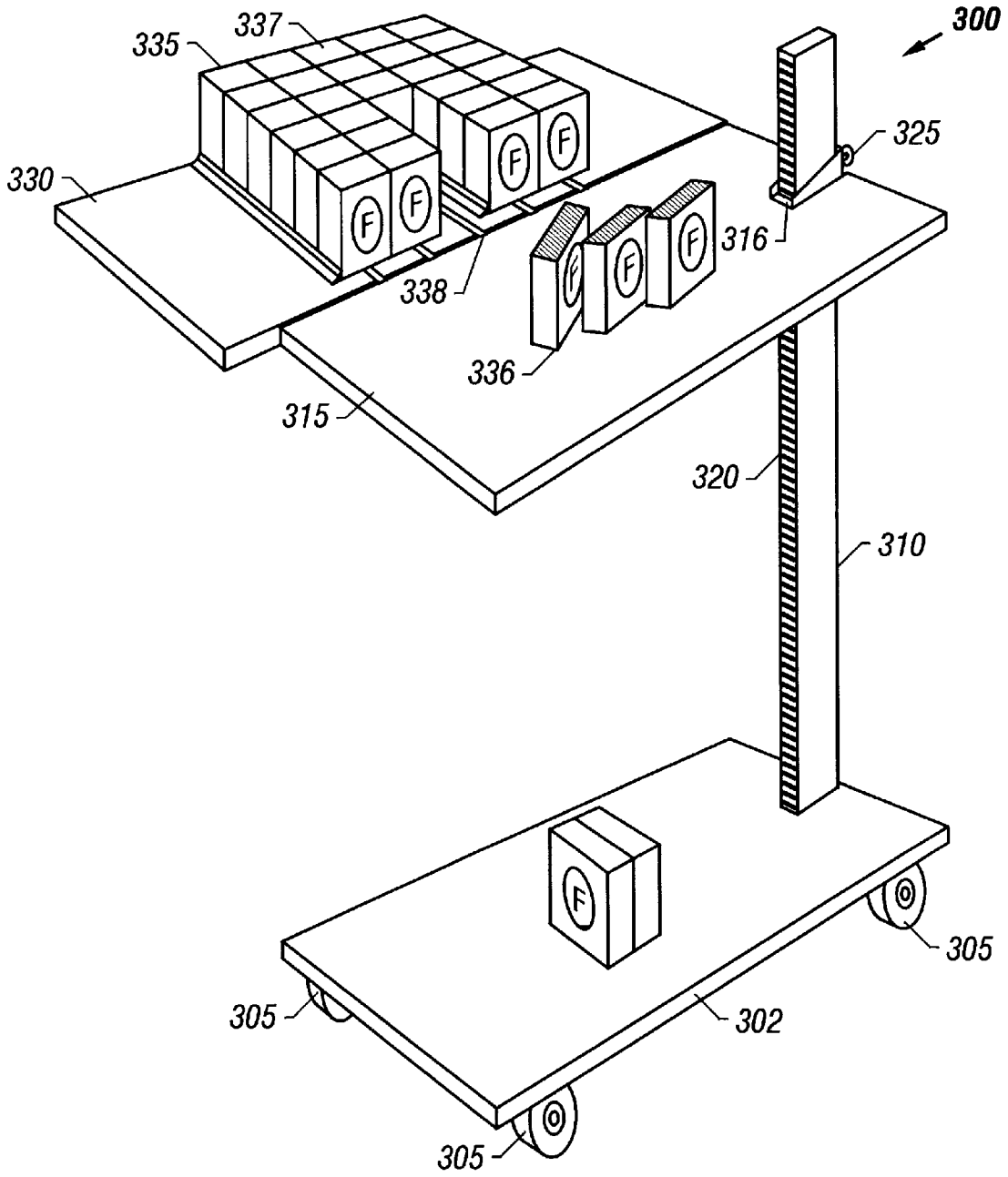
FIG. 6*b* is a perspective view of another step in the product rotation system according to the invention.
Figure 6C:
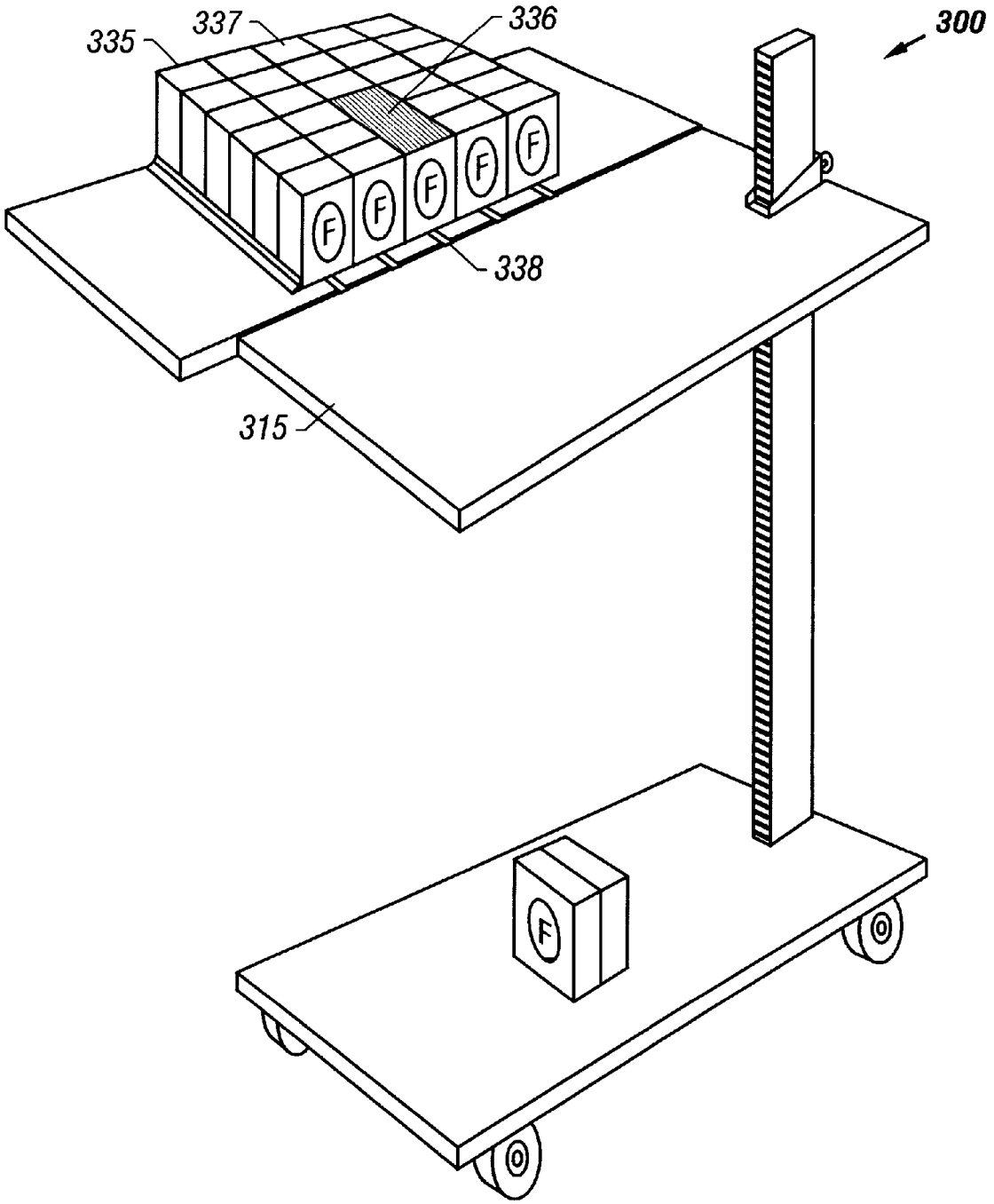
FIG. 6*c* is a perspective view of the final step in the product rotation system according to the invention.

The operator 323 slides older products 336, using the slide bar 322 and display shelf divider tracks 326 according to the invention, onto the movable shelf 315. In FIG. 6*b*, three newer products 337 have been placed in the rotating row 338 according to the invention. The older products 336 remain conveniently on the movable shelf 315 for rotation into the front of row 338. In FIG. 6*c*, the older products 336 are placed into row 338 and receiving means 300 is now able to be moved to another group of products.

Figure 6D:
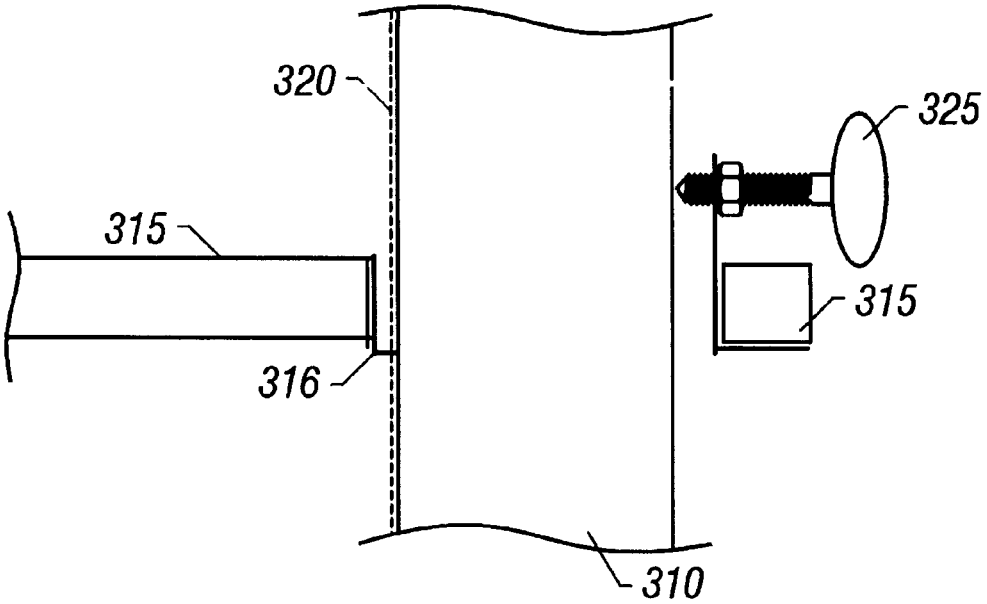
FIG. 6*d* is a side elevational view with portions removed showing the adjusting mechanism for the movable shelf according to the invention.
Figure 6E:
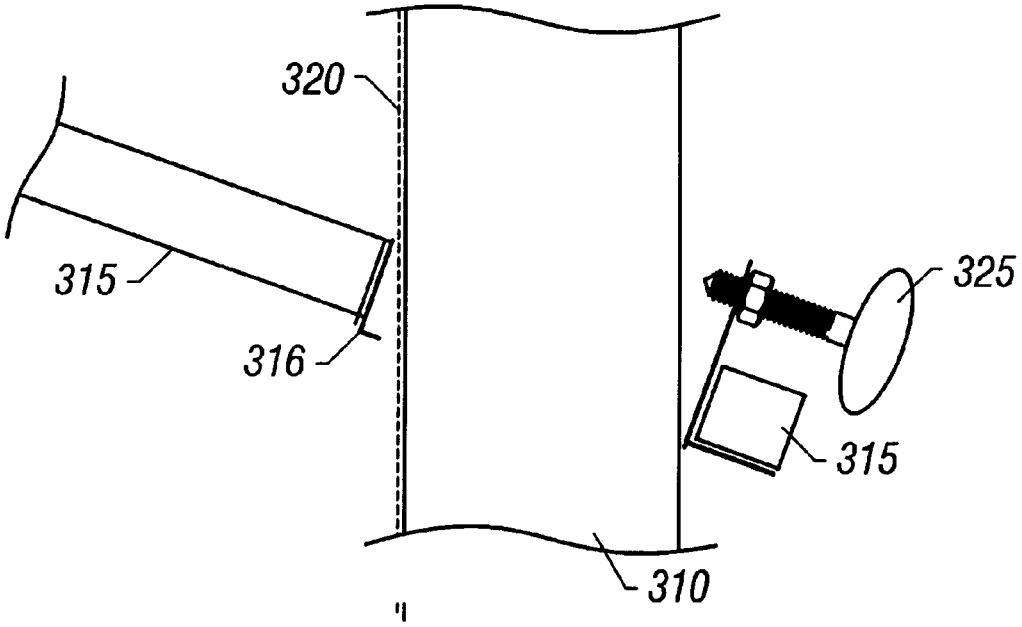
FIG. 6*e* is a side elevational view with portions removed of the adjusting mechanism for the movable shelf according to the invention.

FIG. 6*d* is a cross section with parts removed of the extension 316 of movable shelf 315 engaging slot 320 on the vertical member 310 from FIG. 5*a*. The thumb screw 320 allows an operator to make minor leveling adjustments of the movable shelf extension 316. FIG. 6*e* shows how the movable shelf 315 is maneuvered to adjust its vertical height along member 310. To disengage shelf extension 316 from slot 320, shelf 315 is pivoted about the axis of the member 310 with the end of the shelf 315 opposite thumb screw 325 being maneuvered in an upwardly direction. Once the extension 316 is disengaged from the slot 320, shelf 315 can be moved vertically to another slot 320. To re-engage extension 316 to another slot 320, level the shelf 315 until it is generally parallel to platform 302 and extension 316 is engaging slot 320.

EMBODIMENT 5

Figure 7A:
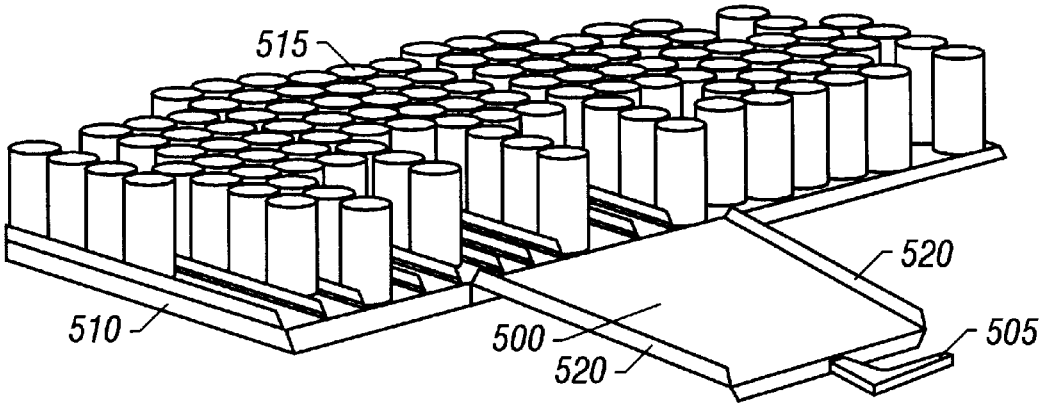
FIG. 7*a* is a perspective view of a rotator tray attached to a shelf according to the invention.
Figure 7B:
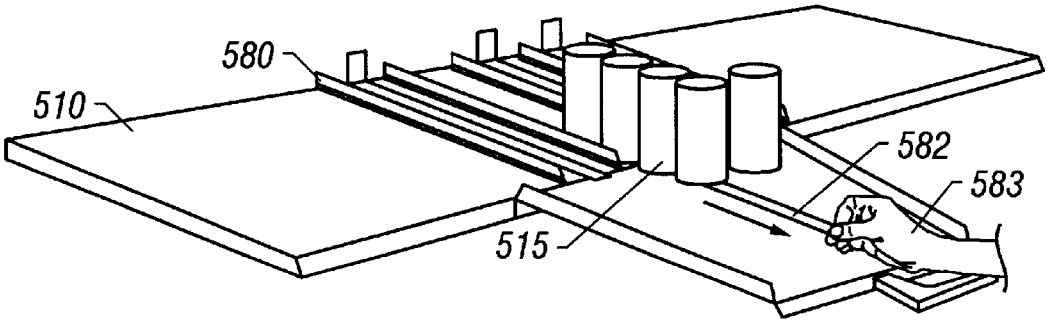
FIG. 7*b* is a perspective view of the rotator tray in FIG. 7*a* with products being placed on the rotator tray according to the invention.
Figure 7C:
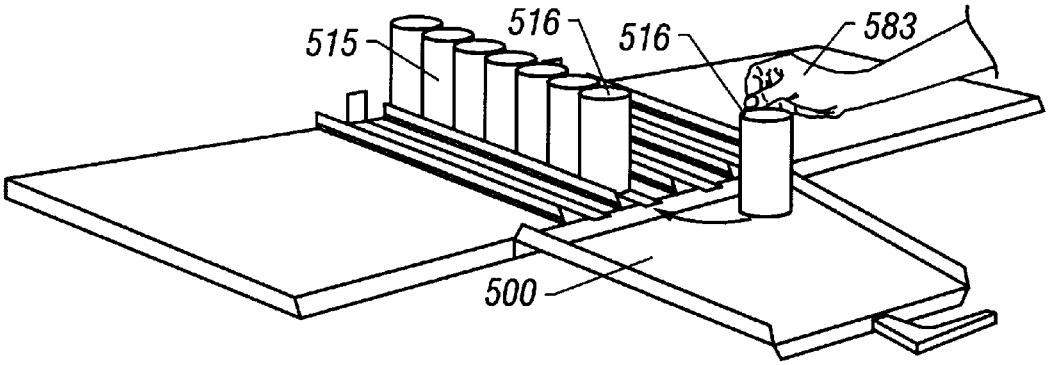
FIG. 7*c* is another perspective view of the rotator tray of FIG. 7*a* according to the invention.

FIGS. 7*a*–7*j* show another embodiment according to the invention that can be used in conjunction with the other embodiments according to the invention to easily and efficiently aid in necessary product display and rotation. FIGS. 7*a*–7*c* show a perspective view of one embodiment according to the invention. A rotator tray 500 with a locking clamp handle 505 is attached to the product shelf 510 holding products 515. Rotator tray 500 has rails 520 on two sides to inhibit products from falling off.

Figure 7D:
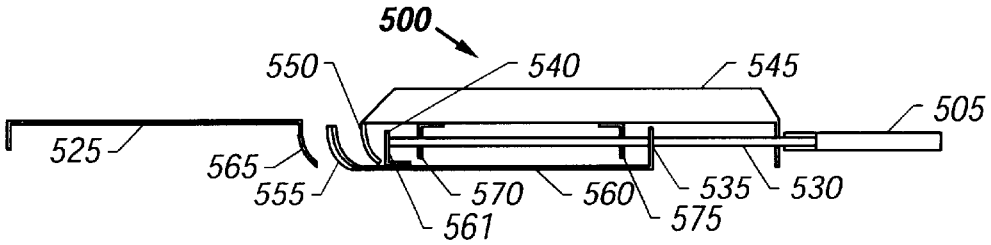
FIG. 7*d* is a side elevational view of the rotator tray according to the invention showing the locking mechanism.

FIGS. 7*d*–7*i* show the locking mechanism for attaching the rotator tray 500 to a standard metal display shelf 525. FIG. 7*d* is a side elevational view of the rotator tray 500 according to the invention with a display shelf. The locking mechanism comprises a locking handle 505 connected to a locking rod 530 which is connected at weld points 535 and 540 to a clamping assembly 560 and support element 561 respectively and having a shelf engaging extension 555 adapted and dimensioned to engage the back of the shelf lip 565. Upper tray 545 has a shelf engaging extension 550 adapted and dimensioned to engage the front of the shelf lip 565 with guides 570 and 575 to maintain locking rod 530 in a predetermined position without inhibiting its movement towards and away from shelf 525.

Figure 7E:
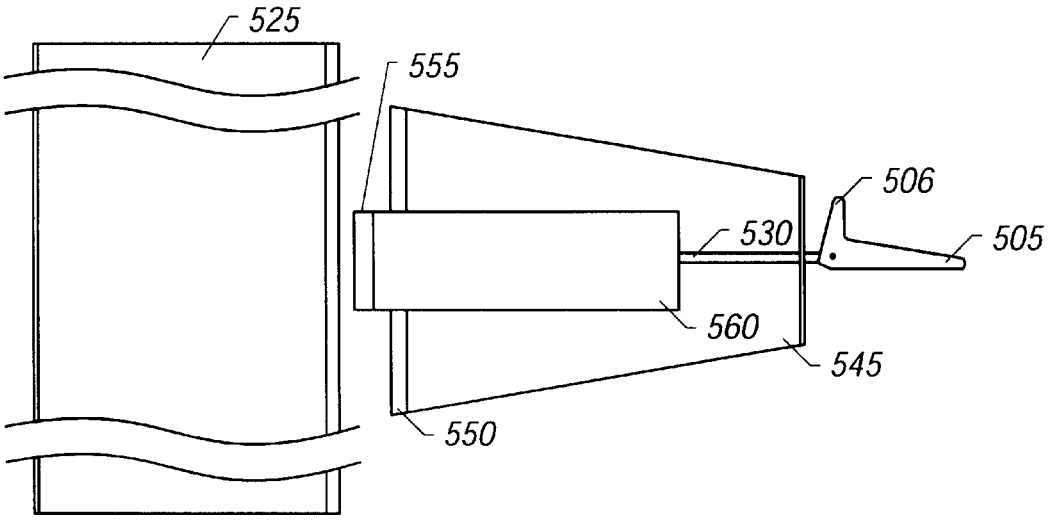
FIG. 7*e* is a bottom plan view of the rotator tray in FIG. 7*d* according to the invention.
Figure 7F:
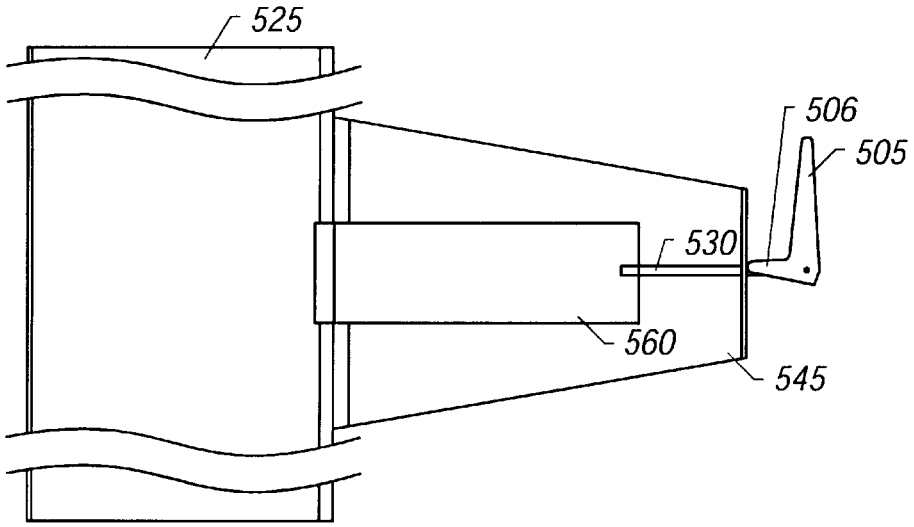
FIG. 7*f* is a bottom plan view of the rotator tray in FIG. 7*d* according to the invention, attached and locked to a display shelf.
Figure 7G:
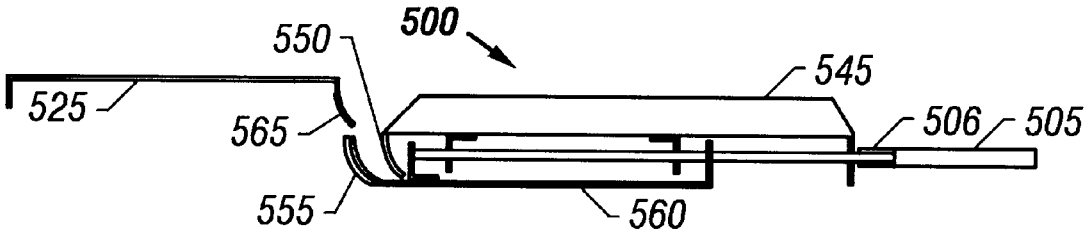
FIG. 7*g* is a side elevational view of the rotator tray in FIG. 7*d* showing a beginning step in attaching the rotator tray to a display shelf according to the invention.
Figure 7H:
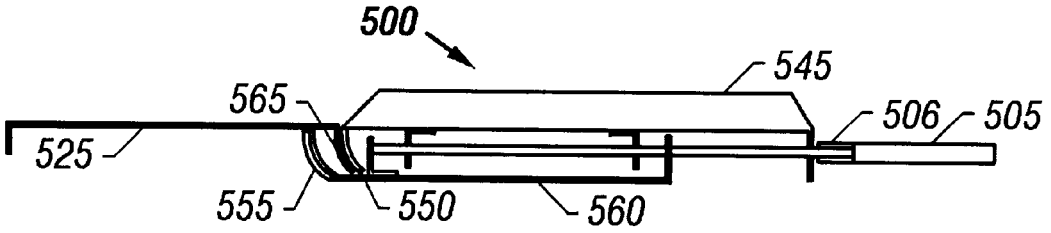
FIG. 7*h* is a side elevational view of the rotator tray in FIG. 7*d* showing an intermediate step in attaching the rotator tray to a display shelf according to the invention.
Figure 7I:
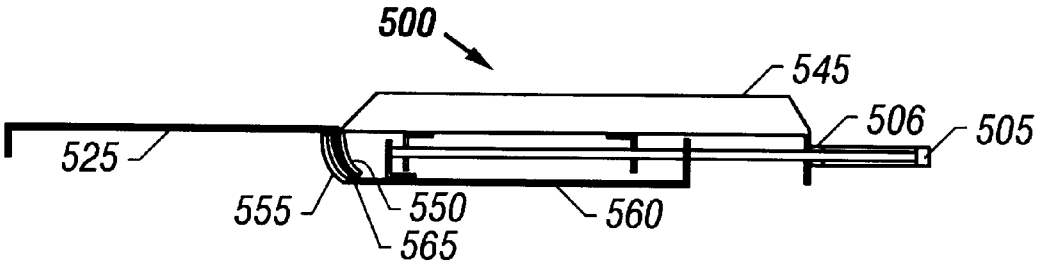
FIG. 7*i* is a side elevational view of the rotator tray in FIG. 7*d* showing the rotator tray attached and locked to a display shelf according to the invention.

FIG. 7*e* shows a plan view of the underside of the embodiment shown in FIG. 7*d* with portions removed. Locking clamp handle 505 is not engaged and rotator tray 500 is unattached to shelf 525. To attach rotator tray 500 to shelf 525, maneuver the rotator tray 500 to position shelf lip 565 between shelf engaging extensions 550 and 555 as shown in FIGS. 7*g* and 7*h*, so that extension 555 is set to engage the back of lip 565 and extension 550 is set to engage the front of lip 565. Applying a force onto locking clamp handle 505, so that locking extension 506 engages upper tray 545, causes clamping assembly 560 to move in a direction away from the shelf 525 and shelf engaging extension 555 to engage the back of shelf lip 565 while simultaneously causing upper tray 545 to move towards shelf 525 causing shelf engaging extension 550 to engage the front of shelf lip 565 as seen in FIG. 7*i*. FIGS. 7*f* and 7*i* show locking handle 505 positioned in a locked position and rotator tray 500 attached to shelf 525.

FIGS. 7*a*–7*c* show an important use for rotator tray 500 once it is attached to shelf 510. Products 515 are moved from shelf 510 onto rotator tray 500. If the aforementioned embodiments according to the invention using shelf dividers 580 are used then the products could be easily transferred to the rotator tray 500 utilizing the slide bar 582 according to the invention as shown in FIG. 7*b*. Utilizing this method will increase productivity and save time. Once the older products 515 have been temporarily transferred to rotator tray 500 newer products 516 can be then positioned towards the back of shelf 510 in a queue. The older products are then placed in a position in front of the newer products 515 to increase the likelihood that the older products will be purchased before the newer products. The rotator tray 500 is dimensioned wide enough to service multiple queues before having to adjust its position.

EMBODIMENT 6

Figure 8A:
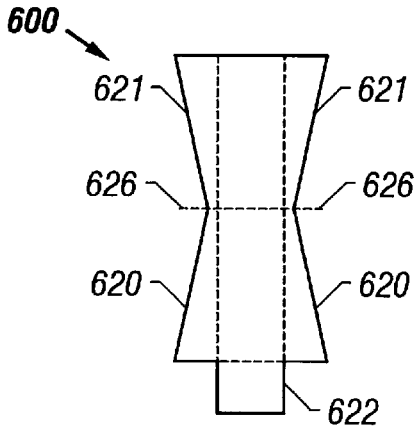
FIG. 8*a* is a top plan view of a support element according to the invention.
Figure 8B:
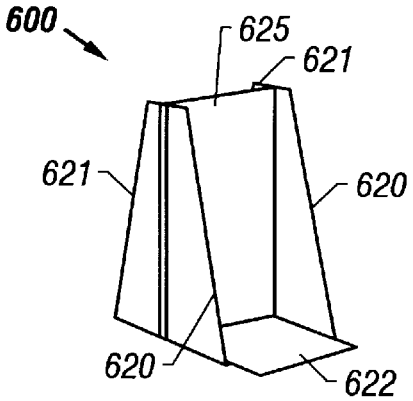
FIG. 8*b* is a perspective view of the support element in FIG. 8*a* according to the invention.
Figure 8C:
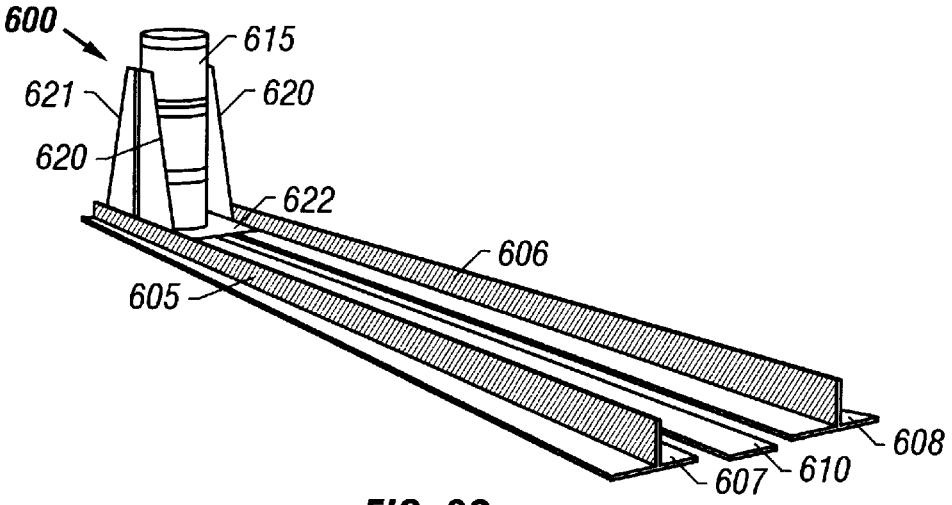
FIG. 8*c* is perspective view of the support element in FIG. 8*a* being used according to the invention.
Figure 8D:
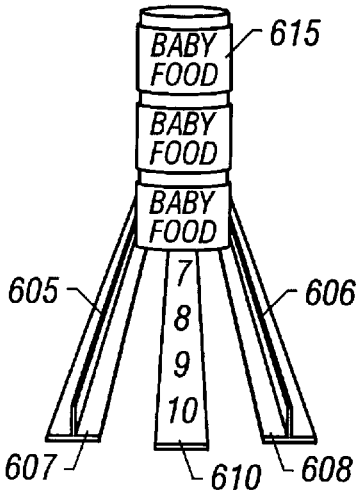
FIG. 8*d* is a front perspective view of the support element being used in FIG. 8*c* according to the invention.

FIGS. 8*a*–8*d* show yet another embodiment according to the invention that enhances the distribution of force over a larger predetermined area than would otherwise be possible with slide bar 610 in FIG. 8*c* and is tall enough to provide a force against smaller products that are to be at least double stacked in a queue, as shown in FIGS. 8*c* and 8*d*. Retail stores are forced to leave some space between products and the shelf above them for enabling a clerk to reach the back products for manually fronting the products. Therefore precious valuable space is lost because the cumulative space above products reduces the number of shelves that can be placed on a row. Because the invention eliminates the need to reach over the products, a retail store is able to eliminate the extra space above products and add more shelf space for displaying more products. Alternatively, the retail store can use the extra space above products to double stack products. Double stacking products allows the store to display more products with one stocking visit and may cut the cost of a stocking person in half since the number of visits normally needed to restock the shelves be cut in half because close to twice the products can now be placed on the shelf.

FIG. 8*c* is a side perspective view of the embodiment according to the invention. It shows display shelf dividers 605 and 606 along with slide bar 610 being positioned according to the invention. FIG. 8*c* also shows a enhancing element 600 positioned in between display shelf dividers 605 and 606 and resting on base plates 607 and 608 above slide bar 610. Enhancing element 600 has, in accordance with the invention, product jars 615 stacked three high in between support walls 620 of enhancing element 600 and on top of support lip 622 of enhancing element 600. Slide bar 610 is positioned to engage the back wall 625 of element 600 in the vicinity of its geometric center generally corresponding to the center of gravity of the product jars 615, thereby allowing the product to be engaged by the slide bar 610 according to the invention for movement with a minimum of forces tending to move the product jars 615 towards one of the display shelf dividers 605 and 606. The support walls 620 and 621 create a stable environment for the product jars 615 by inhibiting the rear product jars 615 from toppling over side ways. Support walls 621 inhibit the weight of product jars 615 from causing back wall 625 of the enhancing element 600 to move backwards. FIG. 8*d* is a front perspective view of the embodiment according to the invention shown in FIG. 8*c*.

The enhancing element can be economically produced using a heavy gauge paperboard. FIG. 8*a* is a plan view of enhancing element 600 with product support walls 620 and back support walls 621. FIG. 8*b* is a perspective view of the arranged enhancing element 600 after it has been folded along line 626.

EMBODIMENT 7

Figure 8E:
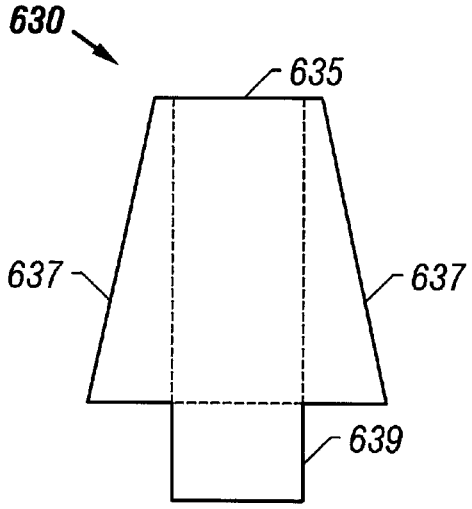
FIG. 8*e* is a top plan view of another embodiment of a support element according to the invention.
Figure 8F:
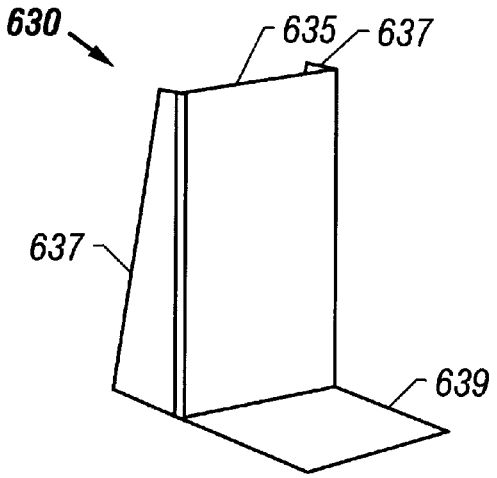
FIG. 8*f* is a perspective view of the support element shown in FIG. 8*e* according to the invention.

FIGS. 8*e* and 8*f* show another embodiment of the enhancing element according to the invention. FIG. 8*e* is a plan view of enhancing element 630 with back support 635, back support walls 637 and a product support lip 639. FIG. 8*f* is a perspective view of the embodiment shown in FIG. 8*e*. In this embodiment the product support walls were removed. Removing the product support walls allows upper parts of the product to be wider than enhancing element 630 yet still receive the support and distribution of force needed for a stable environment.

EMBODIMENT 8

Figure 8G:
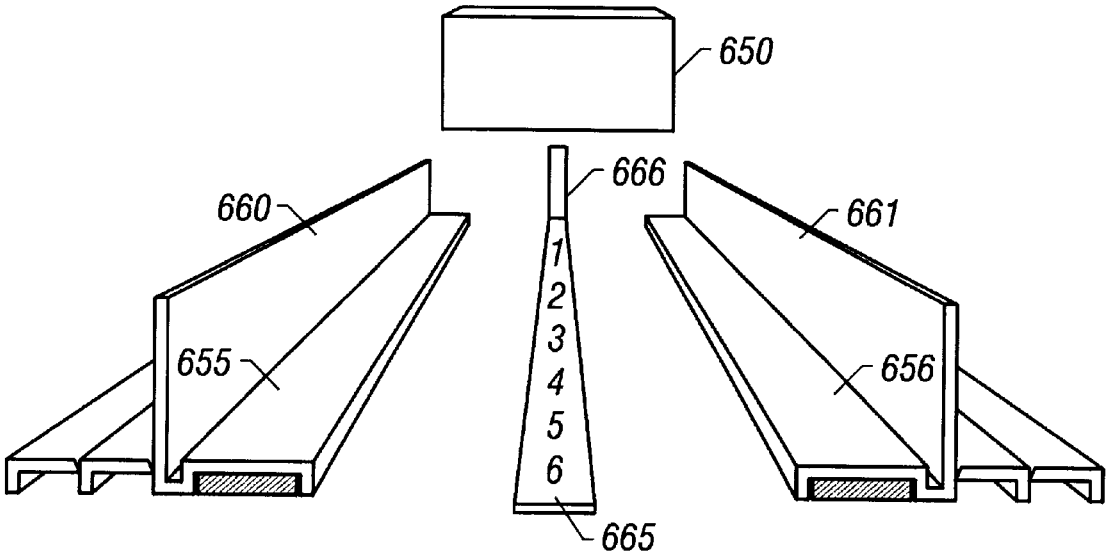
FIG. 8*g* is a perspective view of large product display situation that needs a support element according to the invention.
Figure 8H:
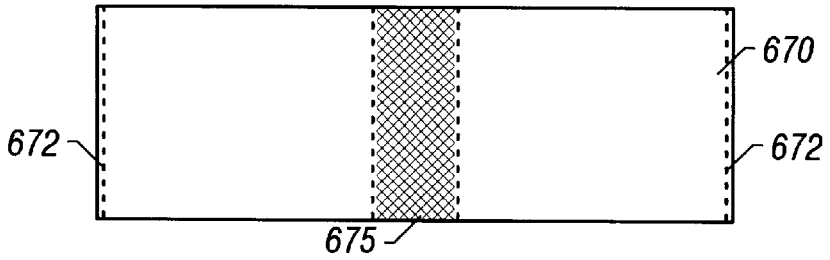
FIG. 8*h* is a front elevational view of another embodiment of a support element according to the invention.
Figure 8I:
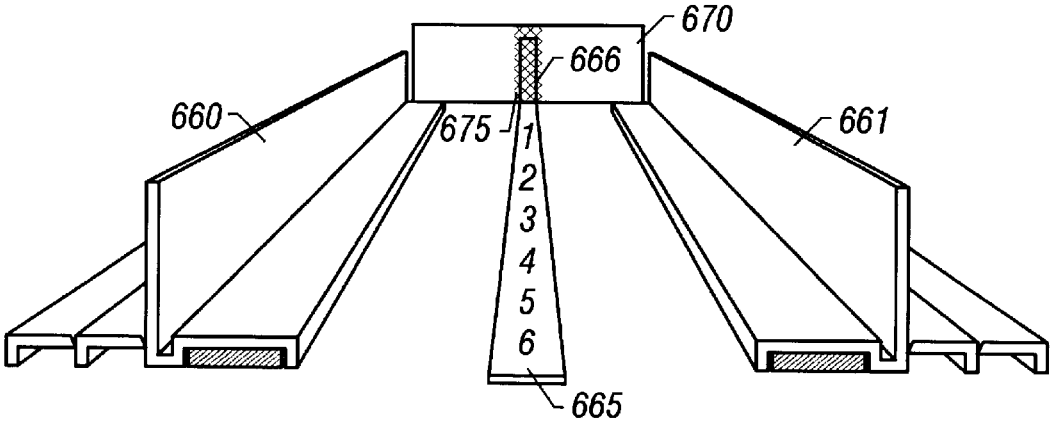
FIG. 8*i* is a perspective view of the support element being used according to the invention.
Figure 8J:
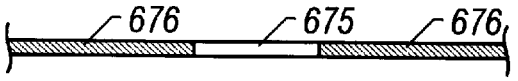
FIG. 8*j* is a cross section with portions removed of the support element in FIG. 8*h* with portions removed along the line 672.

FIGS. 8*h*–8*j* show another embodiment of an enhancing element according to the invention to distribute a force for wider products as seen in FIG. 8*g*. In FIG. 8*g* a wide product 650 is shown being positioned according to the invention on base plates 655 and 656 of display shelf dividers 660 and 661 above slide bar 665. The vertical portion 666 of slide bar 665 is small relative to product 650. Therefore, to minimize the force tending to move the product 650 towards display shelf divider 660 or 661 instead of directly forward according to the invention, the slide bar 665 would need to engage the product 650 at its center of gravity and maintain that position. As the difference in size between the width of the portion 666 and the product 650 increases so does the probability that the product's 650 center of gravity will not be engaged by portion 666. More slide bars could be used in conjunction with slide bar 665 to increase the contact surface area of the back of product 650.

FIG. 8*h* shows an enhancing element 670, adapted to engage the portion 666 of the slide bar 665. The enhancing element 670 is made from a heavy gauge paper board that has been folded in half and glued together except for an area generally in the center of element 670. FIG. 8*j* is a cross section taken of element 670 along line 672 with portions removed. A channel 675 is formed in the area where no glue was applied. The channel is supported on sides 676 by the glued portions of the element 670.

FIG. 8*i* shows element 670 being placed onto slide bar 665 by inserting portion 666 into channel 675. The force needed to move a product engaged by portion 666 and element 670 will be distributed by element 670 which will minimize the forces tending to move the product 650 towards display shelf divider 660 or 661 instead of directly forward according to the invention.

EMBODIMENT 9

Figure 9A:
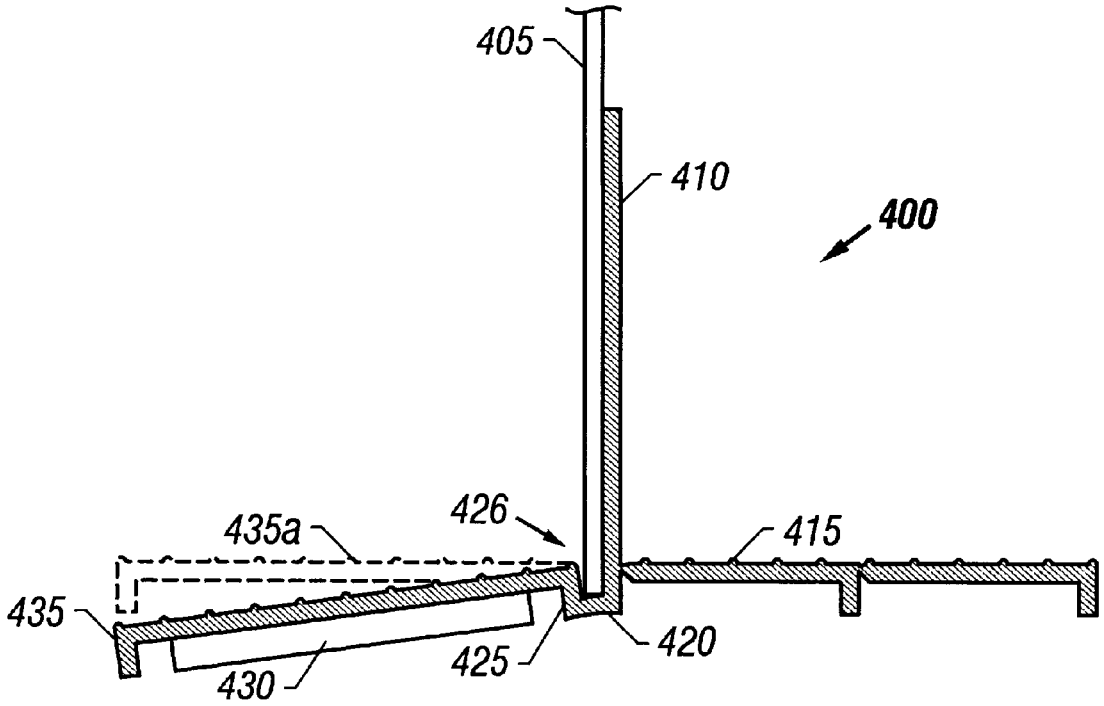
FIG. 9*a* is a front elevational view of another embodiment according to the invention.
Figure 9B:
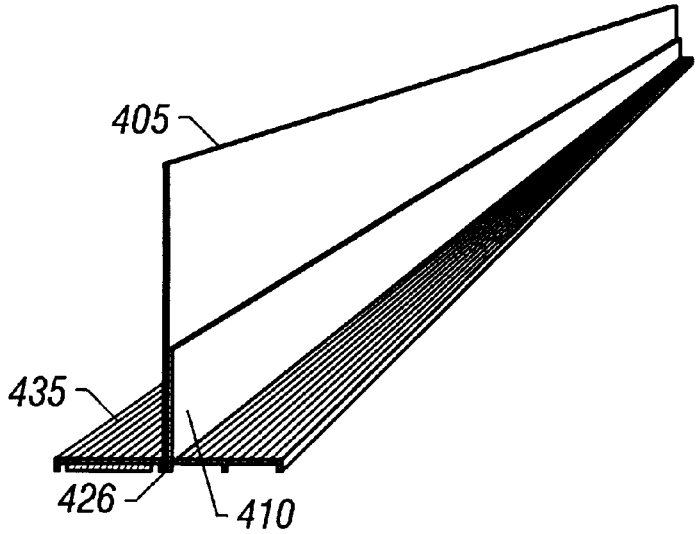
FIG. 9*b* is a perspective view of the embodiment shown in FIG. 9*a*.
Figure 9C:
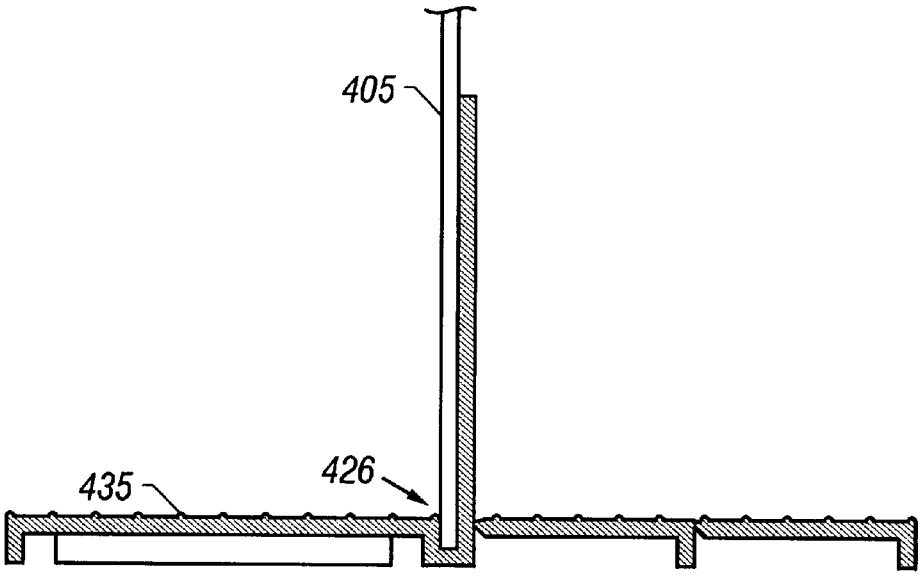
FIG. 9*c* is a front elevational view of the embodiment shown in FIG. 9*a* after a divider extension wall has been added according to the invention.

FIGS. 9*a*–9*c* show yet another embodiment according to the invention that comprises a display shelf divider 400, as also shown in FIGS. 3*a*–3*d*, having a divider wall 410, with base plates 435 and 415, magnetic strip 430 and a divider wall extension 405. Divider wall extension 405 can be inserted into any display shelf divider 400 when products (not shown) are stacked in columns. The divider wall extension is essential to stabilizing the stacked columns and inhibiting the stacked products from falling into adjacent rows.

FIG. 9*a* is a front elevational view of the display shelf divider 400 with divider wall extension 405. A channel 426 is formed by members 420 and 425 where base plate 435 and divider wall 410 meet. Channel 426 extends to the back of display shelf divider 400 and is dimensioned to have a width to receive divider wall extension 405 and engage it so that divider wall extension 405 is held in place. The insertion of divider wall extension 405 into channel 426 can be accomplished with little effort by bending base plate 435 from its normal position 435*a*, so as to widen the opening to the channel 426 and allow divider wall 405 to drop to the bottom of the channel. Movement of base plate 435 to its normal position as shown in FIGS. 9*b* and 9*c* in turn causes divider wall extension 405 to be tightly engaged and prevents it from moving within or out of the channel 426.

Figure 9D:
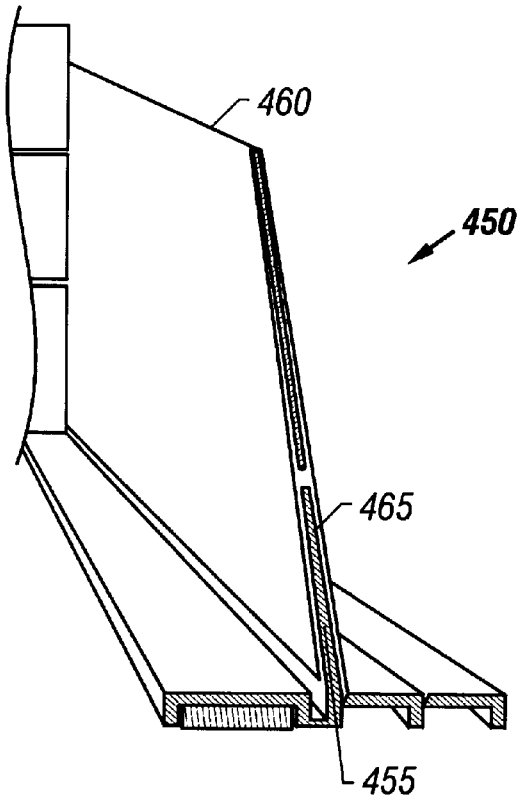
FIG. 9*d* is a perspective view of another embodiment according to the invention.
Figure 9E:
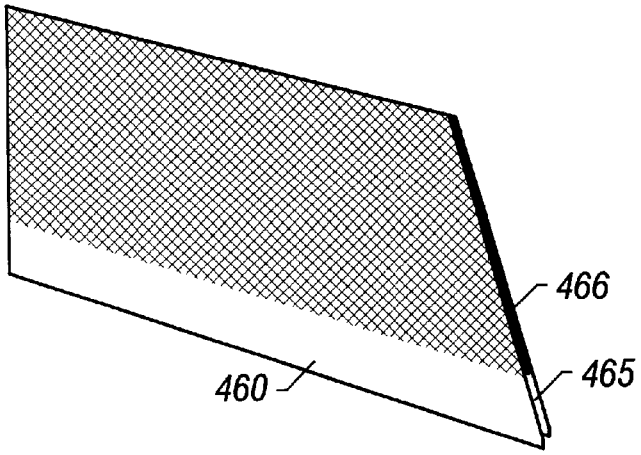
FIG. 9*e* is a perspective view of the vertical divider wall extension shown in FIG. 9*d*.

FIG. 9*d* shows another embodiment according to the invention with a display shelf divider 450 having a vertical tapered divider wall 455 and a similarly vertical tapered divider wall extension 460. The vertical divider wall extension 460 shown is made of paperboard that has been folded over to form a channel 465. The channel is dimensioned to conform to the dimensions of the divider wall 455 by bonding upper portions 466 of the folded paperboard together. The vertical divider wall extension 460 is positioned over divider wall 455 and made to straddle divider wall 455.

Figure 9F:
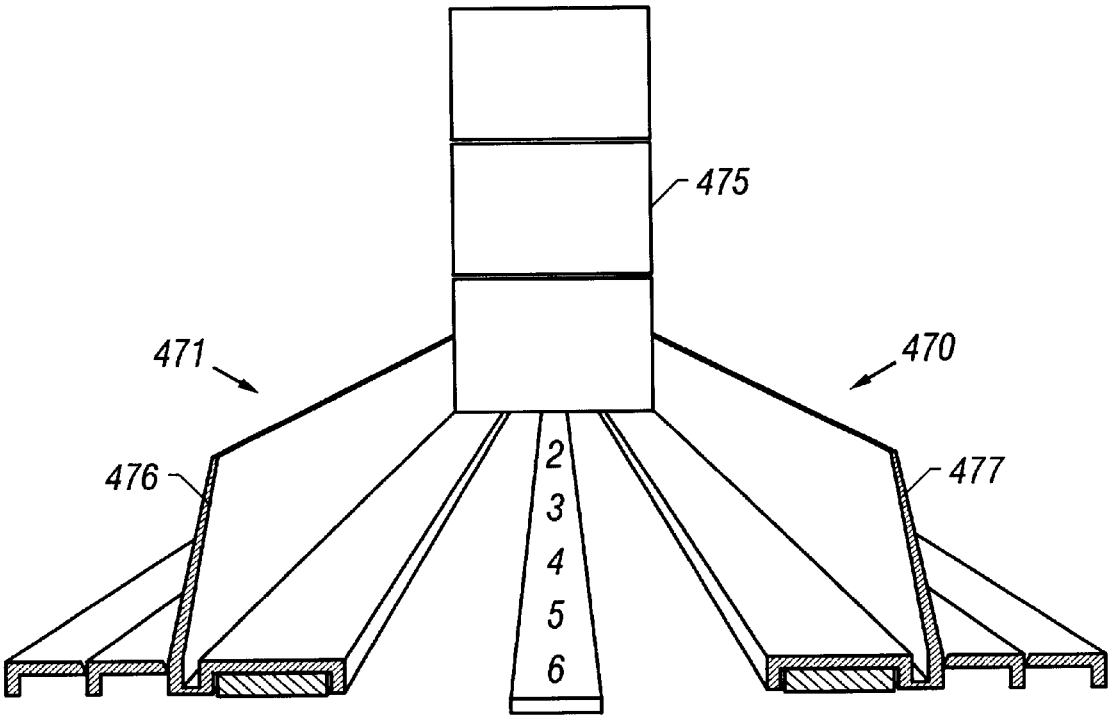
FIG. 9*f* is a perspective view of two display shelf dividers being used according to the invention.

FIG. 9*f* is a perspective view of two display shelf dividers 470 and 471 being used according to the invention, holding a column 475 of products stacked three high. As indicated in FIG. 9*f* the divider walls are dimensioned inadequately heightwise to support the column 475. This arrangement is an example of when one of the aforementioned extender walls may be used.

EXAMPLES

Figure 10A:
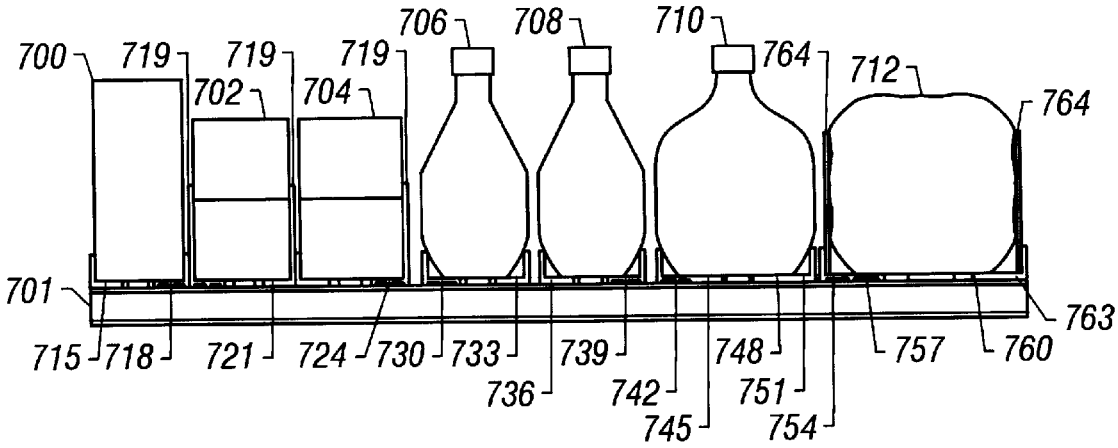
FIG. 10*a* is a front elevational view of a display shelf displaying products according to the invention.
Figure 10B:
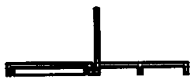
FIG. 10*b* is a front elevational view of a display shelf divider according to the invention.
Figure 10C:
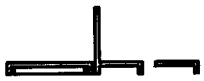
FIG. 10*c* is a front elevational view of an embodiment of a display shelf divider according to the invention.

FIGS. 10*a*–10*e* show examples of embodiments according to the invention that are appropriate for different product arrangements. Shelf display dividers as shown in FIGS. 3*a* 3*e* are being used according to the invention. FIGS. 10*b*–10*e* show examples of different embodiments as also shown in FIGS. 3*a*–3*e*. The arrangements shown in FIG. 10*a* are examples of efficient use of shelf space when displaying irregularly shaped products.

Product 700 is a tall rectangularly shaped product that has been positioned at the side edge of shelf 701. Display shelf divider 715 has been modified to resemble the shelf divider in FIG. 10*d*, allowing the unused side of the divider to become flush with the side of the shelf 701, making for a safer and more aesthetically pleasing display. Shelf divider 718 is the same as the most common shelf divider shown in FIG. 10*b*. This embodiment allows two queues of products to use one display shelf divider.

Products 702 and 704 are double stacked square shaped products. Divider extensions 719 have been used according to the invention as shown in FIGS. 9*a*–9*c* create a more stable environment for the double stacked products 702 and 704. Display shelf divider 721 is the same as the shelf divider in FIG. 10*b*. Display shelf divider 724 is the same as shelf divider in FIG. 10*c*. A portion 780 has been removed to create a predetermined space between products 704 and 706. Product 706 has a small bottom and a wider middle, therefore, when a space is needed between products, the divider shown in FIG. 10*c* can be used, as is the case with dividers 736, 739 and 751. Dividers 730 and 733 are the same as the divider shown in FIG. 10*d*.

Figure 10D:
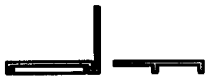
FIG. 10*d* is a front elevational view of an embodiment of a display shelf divider according to the invention.
Figure 10E:
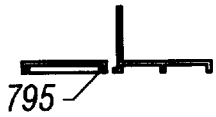
FIG. 10*e* is a front elevational view of an embodiment of a display shelf divider according to the invention.

Product 710 is a large bottle product with a smaller bottom. Having a much wider middle section than a bottom section does not allow a sufficient amount of bottom surface contact when using just one shelf divider for each side of the product queue. Therefore divider 742 is the same as shown in FIG. 10*d* and an extra base support 745 and 748 like element 795 in FIG. 10*e* was provided to give more support to product 710.

Product 712 is of the bag type and will also need more bottom surface area and divider extensions. Accordingly, dividers 754 and 763 with extensions 764, both like the divider shown in FIG. 10*d*, are used in conjunction with elements 757 and 760, which are like element 795 in FIG. 10*e*. Providing more surface are for large bag items, reduces the risk of on side of the bag product 712 from falling off one of the dividers 763 or 754. There has been described a novel device and method. It is evident that those skilled in the art may now make numerous uses and modifications of and departures from the specific embodiments described herein without departing from the inventive concepts. Consequently, the invention is to be construed as embracing each and every feature and novel combination of features present or possessed by devices and methods herein described and limited solely by the spirit and scope of the appended claims.

What is claimed is:

1. A system for displaying products generally forming a queue on a display surface, comprising:

receiving means operable for receiving products to be displayed; said receiving means including a surface for receiving the products in a queue; said surface having front and rear portions and said surface being magnetically attracted to a magnet;

arranging means operable for moving the products selectively and manually from the rear portion of the surface towards the front portion of the surface;

said arranging means comprising a positioning element having a vertical portion adapted to engage the rear product in the queue from the rear side of said product and having a horizontal portion extending parallel to said surface towards said front portion; first and second elements each having a base with an upper and lower portion; said first and second elements being spaced apart and defining a channel to receive and to support said products on said upper portions; said first and second elements being maintained in predetermined positions on said surface magnetically; said horizontal portion being positioned between said first and second elements in said channel and extending under said products so that said vertical portion is positioned to engage the rear product in the vicinity of its geometric center generally corresponding to the center of gravity of said rear product, thereby allowing said rear product to be engaged by said vertical portion for movement from a position in the rear portion to a predetermined position closer to the front portion of said surface with a minimum of forces tending to move said rear product towards one of said first and second elements.

2. The system as claimed in claim 1, wherein said positioning element includes indicia identifying the number of the products in the queue when said positioning element is moved so that the products are substantially aligned with the front portion of the surface.

3. The system as claimed in claim 1, wherein said positioning element includes indicia corresponding to the products in the queue.

4. The system as claimed in claim 3, where said indicia identifies the number of products in the queue when said positioning element is moved so that the products are substantially aligned with the front portion of the surface.

5. The system as claimed in claim 3, wherein said indicia is a bar code.

6. The system as claimed in claim 1, further comprising a temporary shelf extending means for extending the receiving means and receiving products from the surface to facilitate the rotation of older products from the rear portion of the surface to the front portion and newer products to the rear portion of the surface; said shelf extending means comprising means to engage said receiving means for maintaining said shelf extending means in a predetermined position.

7. The system as claimed in claim 1, wherein said first and second elements each comprise a horizontal base and a planar vertical element extending from said base.

8. The system as claimed in claim 1, further comprising an enhancing means for enhancing the distribution of a force on the rear surface of the rear product in said queue so that the force is distributed over a predetermined larger area.

9. The system as claimed in claim 8, wherein said enhancing means has sufficient height to distribute said force against a plurality of rear products arranged vertically.

10. The system as claimed in claim 8, wherein said enhancing means has sufficient height to distribute said force over a plurality of products stacked one on top the other.

11. A method for arranging products to be displayed, comprising the steps of:

providing a shelf with first products arranged in a queue, said shelf having a front and rear portion;

providing second products to be displayed on said shelf in said queue;

providing a movable shelf capable of being positioned to the height of said shelf so that said first products can be moved onto said movable shelf with a smooth transition;

positioning said movable shelf so that it is positioned to receive said first products;

moving said first products from said shelf onto said movable shelf;

moving said second products onto said movable shelf;

positioning said second products towards the rear portion of said shelf; and moving said first products from said movable shelf onto said shelf generally in front of said second products.

12. The method as claimed in claim 11, wherein the number of second products and the number of first products positioned in said queue substantially fill said queue.

13. A system for displaying products generally forming a queue on a display surface, comprising:

receiving means operable for receiving products to be displayed; said receiving means including a surface for receiving the products in a queue; said surface having front and rear portions;

arranging means operable for moving the products selectively and manually from the rear portion of the surface towards the front portion of the surface;

said arranging means comprising a positioning element having a vertical portion adapted to engage the rear product in the queue from the rear side of said product and having a horizontal portion extending parallel to said surface towards said front portion; first and second elements each having a base with an upper and lower portion and a vertical member extending upward from said upper portion; said first and second elements being spaced apart and defining a channel to receive and to support said products on said upper portions; attaching means operable for maintaining said first and second elements in predetermined positions on said surface; said horizontal portion being positioned between said first and second elements in said channel and extending under said products so that said vertical portion is positioned to engage the rear product in the vicinity of its geometric center generally corresponding to the center of gravity of said rear product, thereby allowing said rear product to be engaged by said vertical portion for movement from a position in the rear portion to a predetermined position closer to the front portion of said surface with a minimum of forces tending to move said rear product towards one of said first and second elements; and a temporary shelf extending means for extending the receiving means and receiving products from the surface to facilitate the rotation of older products from the rear portion of the surface to the front portion and newer products to the rear portion of the surface; said shelf extending means comprising means to engage said receiving means for maintaining said shelf extending means in a predetermined position.

* * * * *